US009333138B2

(12) United States Patent
Moriarty et al.

(10) Patent No.: US 9,333,138 B2
(45) **Date of Patent: *May 10, 2016**

(54) HOSPITAL BED HAVING PATIENT LIFTING DEVICE

(71) Applicant: Hill-Rom Services, Inc., Batesville, IN (US)

(72) Inventors: Joshua J. Moriarty, South Attleboro, MA (US); Thomas K. Skripps, Acton, MA (US); Andrea L. Lewis, Mt. Pleasant, SC (US); Peter A. Rankis, Acton, MA (US)

(73) Assignee: Hill-Rom Services, Inc., Batesville, IN (US)

( * ) Notice: Subject to any disclaimer, the term of this patent is extended or adjusted under 35 U.S.C. 154(b) by 240 days.

This patent is subject to a terminal disclaimer.

(21) Appl. No.: 14/102,914

(22) Filed: Dec. 11, 2013

(65) Prior Publication Data

US 2014/0096319 A1 Apr. 10, 2014

Related U.S. Application Data

(63) Continuation of application No. 13/042,502, filed on Mar. 8, 2011, now Pat. No. 8,607,378.

(60) Provisional application No. 61/311,908, filed on Mar. 9, 2010, provisional application No. 61/311,916, filed on Mar. 9, 2010, provisional application No. 61/312,300, filed on Mar. 10, 2010, provisional application No. 61/353,027, filed on Jun. 9, 2010.

(51) Int. Cl.
*A61G 7/10* (2006.01)
*A61G 7/00* (2006.01)

(52) U.S. Cl.
CPC ..... *A61G 7/1017* (2013.01); *A61G 7/001* (2013.01); *A61G 7/1015* (2013.01);

(Continued)

(58) Field of Classification Search
CPC . A61G 7/1015; A61G 7/1017; A61G 7/1051; A61G 7/1061; A61G 7/1076
USPC ..... 5/81.1 R, 83.1–89.1, 662; 602/33, 34
See application file for complete search history.

(56) References Cited

U.S. PATENT DOCUMENTS 2,259,757 A * 10/1941 Longfellow ..... 602/34
2,272,778 A 2/1942 Reuter (Continued)

FOREIGN PATENT DOCUMENTS

AU 591951 12/1989
CD 806 989 6/1951

(Continued)

OTHER PUBLICATIONS

European search report from EP 11 15 7437 dated Jul. 28, 2011, 6 pages.

(Continued)

*Primary Examiner* — David E Sosnowski
(74) *Attorney, Agent, or Firm* — Barnes & Thornburg LLP

(57) ABSTRACT

A caregiver assist device for use with a patient support apparatus is disclosed. The caregiver assist device including a support structure, a boom, a helper belt, and a constant force spring assembly. The boom extends from the support structure over the patient support apparatus. The helper belt is supported along the boom and has a first end and a second end. The constant force spring assembly includes a constant force spring coupled between the support structure and the first end of the helper belt so that a constant counterbalancing force is applied to the helper belt in response to a patient force being applied to the second end of the helper belt.

15 Claims, 25 Drawing Sheets

(52) U.S. Cl.
CPC ..... *A61G 7/1023* (2013.01); *A61G 7/1051* (2013.01); *A61G 7/1061* (2013.01); *A61G 7/1076* (2013.01); *A61G 2200/32* (2013.01); *A61G 2200/322* (2013.01); *A61G 2200/34* (2013.01); *A61G 2200/36* (2013.01); *A61G 2203/12* (2013.01)

(56) References Cited

U.S. PATENT DOCUMENTS

| | | | | |
|---|---|---|---|---|
| 2,706,120 | A | | 4/1955 | Stratton |
| 3,006,485 | A | | 10/1961 | Martin |
| 3,077,613 | A | | 2/1963 | Mayer |
| 3,490,385 | A | | 1/1970 | Wallace et al. |
| 4,202,062 | A | | 5/1980 | Marcyan |
| 4,253,207 | A | | 3/1981 | Marcyan |
| 4,296,509 | A | | 10/1981 | Simmons et al. |
| 4,340,984 | A | | 7/1982 | Marcyan |
| 4,530,122 | A | | 7/1985 | Sanders et al. |
| 4,593,422 | A | | 6/1986 | Wolpert, Jr. et al. |
| 4,627,119 | A | | 12/1986 | Hachey et al. |
| 4,644,595 | A | | 2/1987 | Daniel |
| 4,847,930 | A | | 7/1989 | Spath |
| 4,932,090 | A | | 6/1990 | Johansson |
| 5,005,233 | A | | 4/1991 | Toivio et al. |
| 5,038,425 | A | | 8/1991 | Merry |
| 5,158,188 | A | | 10/1992 | Nordberg |
| 5,327,592 | A | | 7/1994 | Stump |
| 5,337,908 | A | | 8/1994 | Beck, Jr. |
| 5,406,658 | A | * | 4/1995 | Olkkonen et al. ..... 5/83.1 |
| 5,539,941 | A | | 7/1996 | Fuller |
| 5,549,264 | A | | 8/1996 | West |
| 5,560,054 | A | | 10/1996 | Simon |
| 5,704,881 | A | | 1/1998 | Dudley |
| 5,737,781 | A | | 4/1998 | Votel |
| 5,802,641 | A | | 9/1998 | Van Steenburg |
| 5,836,026 | A | | 11/1998 | Reed |
| 5,890,238 | A | | 4/1999 | Votel |
| 6,006,377 | A | | 12/1999 | Asakawa |
| 6,035,465 | A | | 3/2000 | Rogozinski |
| 6,141,806 | A | | 11/2000 | Bobey et al. |
| 6,216,293 | B1 | | 4/2001 | Ruschke |
| 6,240,583 | B1 | | 6/2001 | Brooke et al. |
| 6,341,393 | B1 | | 1/2002 | Votel |
| 6,378,148 | B1 | | 4/2002 | Votel |
| 6,397,416 | B2 | | 6/2002 | Brooke et al. |
| 6,539,569 | B2 | | 4/2003 | O'Connell |
| 6,568,003 | B1 | | 5/2003 | Vest |
| 6,581,897 | B2 | | 6/2003 | Ruschke |
| 6,637,610 | B1 | | 10/2003 | Cheeseboro |
| 6,679,510 | B2 | | 1/2004 | Perena |
| 6,880,186 | B2 | | 4/2005 | Johansson |
| 6,907,625 | B2 | | 6/2005 | Nomura |
| 7,237,491 | B2 | | 7/2007 | Faucher et al. |
| 7,462,138 | B2 | | 12/2008 | Shetty et al. |
| 7,536,738 | B2 | | 5/2009 | Richards et al. |
| 7,540,045 | B2 | | 6/2009 | Nativ |
| 7,556,606 | B2 | | 7/2009 | Krebs et al. |
| 7,634,824 | B2 | | 12/2009 | Gramkow et al. |
| 7,725,964 | B2 | | 6/2010 | Minning et al. |
| RE41,412 | E | | 7/2010 | Van Steenburg |
| 7,921,484 | B2 | | 4/2011 | Bendele et al. |
| 8,607,378 | B2 | * | 12/2013 | Moriarity et al. ..... 5/83.1 |
| 2004/0006819 | A1 | | 1/2004 | Johansson |
| 2005/0097670 | A1 | | 5/2005 | Hawk et al. |
| 2006/0162083 | A1 | * | 7/2006 | Heimbrock ..... 5/662 |
| 2006/0168728 | A1 | | 8/2006 | Strobel et al. |
| 2006/0179576 | A1 | | 8/2006 | Richards et al. |
| 2007/0240260 | A1 | | 10/2007 | White et al. |
| 2008/0201843 | A1 | | 8/2008 | Bendele et al. |
| 2008/0216232 | A1 | | 9/2008 | White et al. |
| 2010/0064442 | A1 | | 3/2010 | Riehm et al. |
| 2012/0198631 | A1 | | 8/2012 | Heimbrock et al. |

FOREIGN PATENT DOCUMENTS

| | | |
|---|---|---|
| EP | 0610664 | 8/1994 |
| GB | 2 275 607 | 9/1994 |
| JP | 07-016269 | 1/1995 |
| JP | 09-173391 | 7/1997 |
| JP | 2002-263148 | 9/2002 |
| WO | WO 92/00052 | 1/1992 |
| WO | WO 92/16176 | 10/1992 |
| WO | WO 02/15834 | 2/2002 |
| WO | WO 2004/060257 | 7/2004 |

OTHER PUBLICATIONS

Installation Instructions for the TotalCare Patient Helper, Texas Medical Industries, Inc. (2 pages).

OSI Patient Helper for Hill-Rom TotalCare, Orthopedic System, Inc. (2 pages).

* cited by examiner

HOSPITAL BED HAVING PATIENT LIFTING DEVICE

This application is a continuation of U.S. application Ser. No. 13/042,502, filed Mar. 8, 2011, as now U.S. Pat. No. 8,607,378, which claims the benefit, under 35 U.S.C. §119 (e), of U.S. Provisional Patent Application No. 61/311,908 which was filed Mar. 9, 2010, U.S. Provisional Patent Application No. 61/311,916 which was filed Mar. 9, 2010, U.S. Provisional Patent Application No. 61/312,300, which was filed Mar. 10, 2010, and U.S. Provisional Patent Application No. 61/353,027, which was filed Jun. 9, 2010, and each of which are hereby incorporated by reference herein in their entirety.

BACKGROUND

The present disclosure is related to a patient support apparatus with a caregiver assist device. More specifically, the present disclosure is related to a patient support apparatus with a caregiver assist device for assisting with patient movement at the patient support apparatus.

Patient support apparatuses known in the art are used in conjunction with patient lifts for assisting with patient movement at the patient support apparatus. Some patient support apparatuses are used with patient lifts that have electric wenches or drives for assisting with patient movement at the patient support apparatus.

In the prior art, a caregiver would operate patient a patient lift wench or motor by directing the lift to raise or lower a patient at the patient support. Such operation could often require heavy duty wenches and motors to be precisely operated by a caregiver to help a patient move around a patient support apparatus.

SUMMARY

The present application discloses one or more of the features recited in the appended claims and/or the following features which, alone or in any combination, may comprise patentable subject matter:

A caregiver assist device for use with a patient support apparatus is disclosed. The caregiver assist device may include a support structure, a boom, a helper belt, and a constant force spring assembly. The boom may extend from the support structure over the patient support apparatus. The helper belt may be supported along the boom and may have a first end and a second end. The constant force spring assembly may include a constant force spring coupled between the support structure and the first end of the helper belt so that a constant counterbalancing force is applied to the helper belt in response to a patient force being applied to the second end of the helper belt.

In some embodiments, the support structure may include a base portion and an upper portion extending upwardly from the base portion. The constant force spring assembly may include a carrier slidably coupled to the base portion and the constant force spring may have a first end secured to the carrier. The base portion may include a channel that guides the sliding movement of the carrier with respect to the base portion of the support structure. The constant force spring may have a second end secured to the base portion of the support structure. The constant force spring may include a constant force spring band and a spindle.

It is contemplated that the constant force spring assembly may also include a spool and an electric motor configured to drive the spool. The helper belt may be secured to the spool so that the helper belt is wound and unwound from the spool in response to the electric motor driving the spool. In some such embodiments, the constant force spring assembly may include a carrier slidably coupled to the support structure and the spool and the electric motor may be secured to the carrier for movement with the carrier.

The support structure may include a base portion and an upper portion, the upper portion extending up from the top of the base portion and having a channel sized to guide the helper belt. The constant force spring assembly may include a carrier housed inside the base portion and slidable relative to the base portion. The constant force spring may be secured to the carrier and to the bottom of the base portion to bias the carrier toward the bottom of the base portion. The first end of the helper belt may be coupled to the carrier so that the carrier is moved away from the bottom of the base portion in response to a patient force greater than the force produced by the constant force spring being applied to the second end of the helper belt.

A caregiver assist device may include a support structure, a boom, a helper belt, and a constant force spring assembly. The support structure may include a base portion and an upper portion extending upwardly from the base portion. The boom may have a proximal end and a remote end, the proximal end may be coupled to the upper portion of the support structure for pivotable motion relative to the upper portion of the support structure about an axis. The helper belt may be supported along the upper portion of the support structure and along the boom. The helper belt may have a first end and a second end. The constant force spring assembly may include a constant force spring coupled between the base portion of the support structure and the first end of the helper belt so that a constant counterbalancing force is applied to the helper belt in response to a patient force being applied to the second end of the helper belt.

In some embodiments, such a caregiver assist device may include a proximal belt guide with a yoke pivotably coupled to the upper portion of the support structure and a yoke roller secured to the yoke for movement therewith. The helper belt may engage the yoke roller so that the yoke is pivoted relative to the upper portion of the support structure in response to the boom being pivoted relative to the upper portion of the support structure.

The caregiver assist device may also include a remote belt guide secured to the remote end of the boom including a first remote guide roller. The remote belt guide may be pivotable relative to the boom about an axis extending along the boom.

It is contemplated that the boom may include a base arm, a carriage with an accessory rail slidably coupled to the base arm, and a carriage lock movable between a locked position and an unlocked position. In the locked position, the carriage lock may block movement of the carriage along the base arm. In the unlocked position, the carriage lock may allow slidable movement of the carriage along the base arm.

The caregiver assist device may also include an assist belt with a first end and a second end and an inertia reel. The first end of the assist belt may be coupled to the inertia reel. The inertia reel may be secured to the upper portion of the support structure and the boom may include a carriage slidably coupled to the boom. The carriage may include a clip supporting the assist belt between the first and second ends of the assist belt.

In some embodiments, the boom may include a base arm, an extension, and an extension latch. The base arm may be pivotably coupled to the upper portion of the support structure. The extension may be pivotable about a horizontal axis relative to the base arm. The extension latch may be movable between a locked position, blocking pivotable movement of the extension relative to the base arm, and an unlocked position, allowing pivotable movement of the extension relative to the base arm.

It is contemplated that the second end of the assist belt may be coupled to a holder with a pair of spaced apart hooks. In some such embodiments, the holder may include a bar extending between each of the hooks and a universal joint coupled to the bar between the hooks and secured to the assist belt. In some embodiments, the caregiver assist device may include a garment with a strap, a first loop coupled to a first end of the strap, and a second loop coupled to a second end of the strap. The strap may be configured to wrap around the back of a patient wearing the garment so that the first loop and the second loop are positioned to engage the pair of hooks of the holder.

A caregiver assist device may include a support structure, a boom, and a carriage. The support structure may extend substantially vertically. The boom may include a base arm and an extension situated above the base arm. The carriage may be slidably coupled to the boom. The base arm may also be pivotably coupled to the support structure for movement about a substantially vertical axis extending along the support structure and the extension may be pivotably coupled to the base arm for movement about a substantially horizontal axis.

In some embodiments, the extension, for example, may be L-shaped. It is contemplated that the extension may move between a use position, where a remote end of the extension is above the base arm, and a stowed position, where the remote end of the extension is below the base arm. The extension may also include an extension lock movable between a locked position, blocking pivotable movement of the extension relative to the base arm, and an unlocked position, allowing pivotable movement of the extension relative to the base arm.

The carriage may be slidably coupled to the base arm. The carriage may include accessory rails along left and right sides of the carriage. The caregiver assist device may also include an inertia reel and an assist belt wound on the inertia reel. The assist belt may be supported by the carriage. The carriage may be slidably coupled to the base arm. The inertia reel may be coupled to the support structure.

Additional features, which alone or in combination with any other feature(s), including those listed above and those listed in the claims may comprise patentable subject matter and will become apparent to those skilled in the art upon consideration of the following detailed description of illustrative embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION OF THE DRAWINGS

Figure 1:
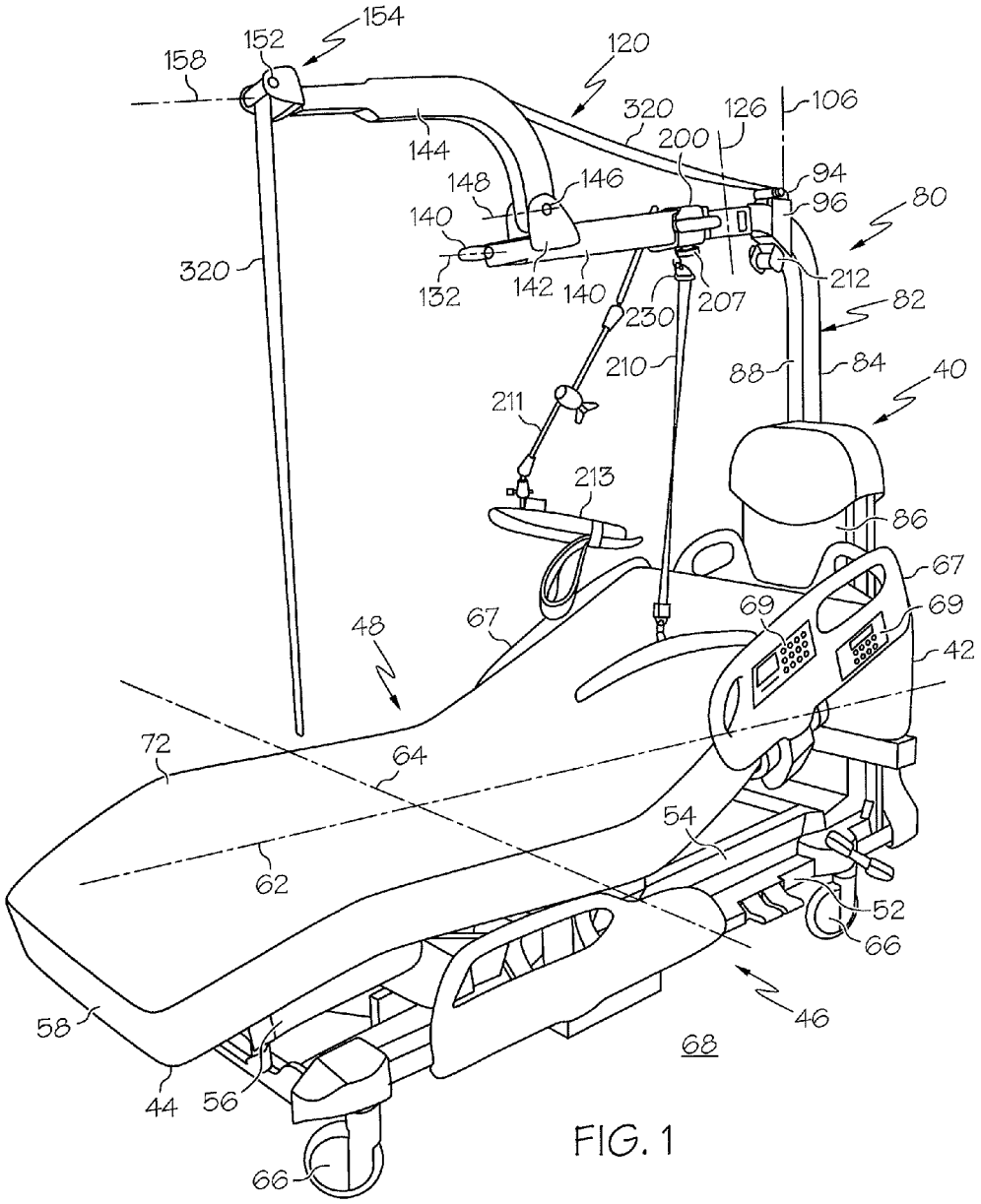
FIG. 1 is a perspective view of a caregiver assist device with a support structure coupled to a patient support apparatus and a boom extending over a support apparatus.

A patient support apparatus, illustratively a hospital bed 40, is shown in FIG. 1 with a caregiver assist device 80 coupled to the bed 40. Device 80 is configured to help a patient getting up from bed 40 as suggested in FIGS. 24-28 by lifting up on the patient with a constant counterbalancing force as the patient moves around bed 40. Device 80 is also configured to assist a caregiver in pulling a patient up in bed 40 as suggested in FIG. 22 or turning a patient supported on bed 40 as suggested in FIG. 23.

Device 80 is configured to provide patient mobility support by applying a helper force that is less than a patient's weight to the patient, thereby reducing the effective weight of the patient at bed 40 as suggested in FIGS. 24-28. Device 80 includes a frame 82, a constant force spring assembly 270, and a helper belt 320 as shown in FIGS. 1-5. Constant force spring assembly 270 produces the helper force across a range of spring motion and helper belt 320 transmits the helper force from the constant force spring assembly 270 to the patient. Thus, a patient secured to helper belt 320 can move around bed 40 with the helper force lifting a portion of the patient's weight up toward frame 82.

In practice, a caregiver secures helper belt 320 to a patient wearing a gown 240 on bed 40 and then increases tension in helper belt 320 until the belt is tight and the constant force spring assembly 270 applies the helper force to helper belt 320. The patient can then, by himself or with the help of the caregiver, maneuver on and around bed 40 while his effective weight is reduced by the helper force. Because the constant force spring assembly 270 applies the helper force across a range of motion, the caregiver need not constantly adjust the length of helper belt 320 to continue the reduction of the patient's effective weight as the patient moves around bed 40.

Figure 22:
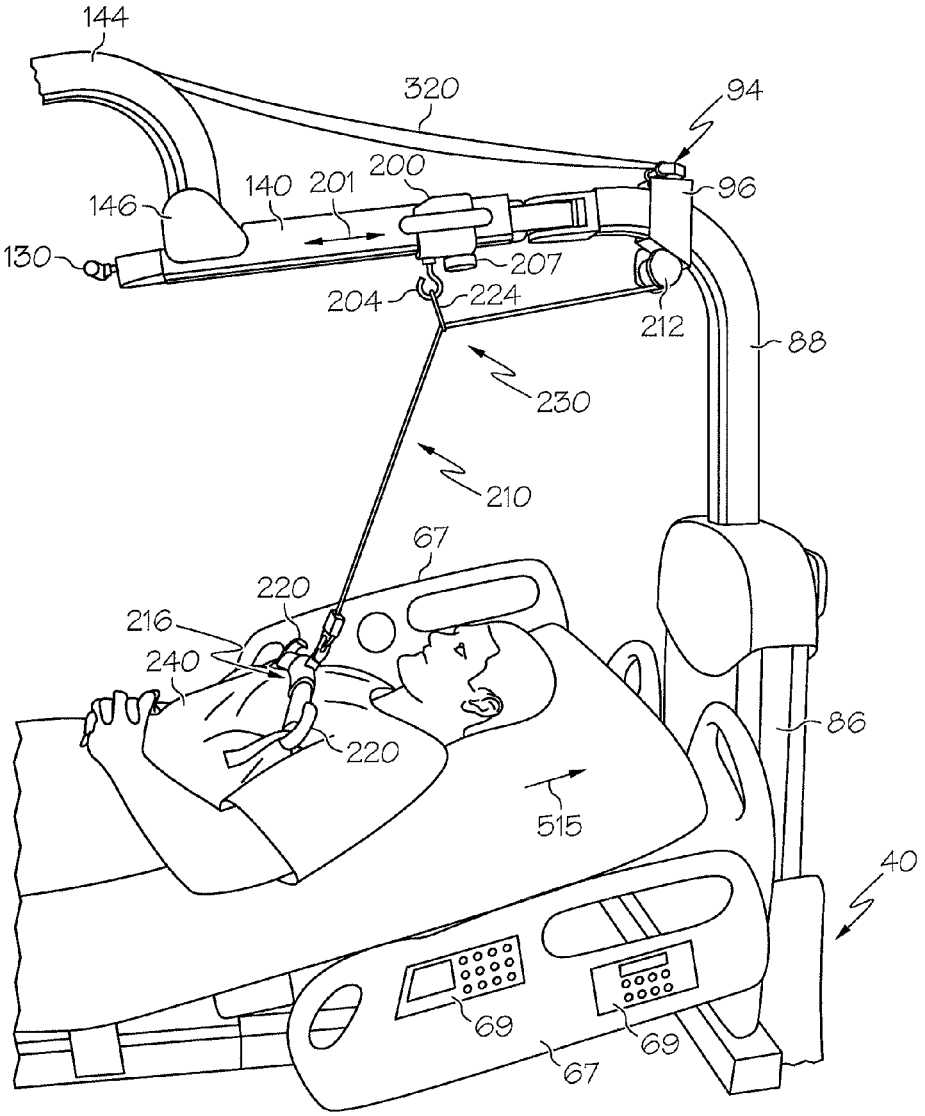
FIG. 22 is a perspective view of the caregiver assist device of FIG. 1 showing the assist belt extending from an inertia reel and through the clip supported on the carriage of FIGS. 9, 11, 13 and coupled to a patient wearing the gown of FIGS. 14-17 so that the patient can be pulled up on the patient support apparatus toward the carriage in response to the elevation of the support surface being lowered.
Figure 23:
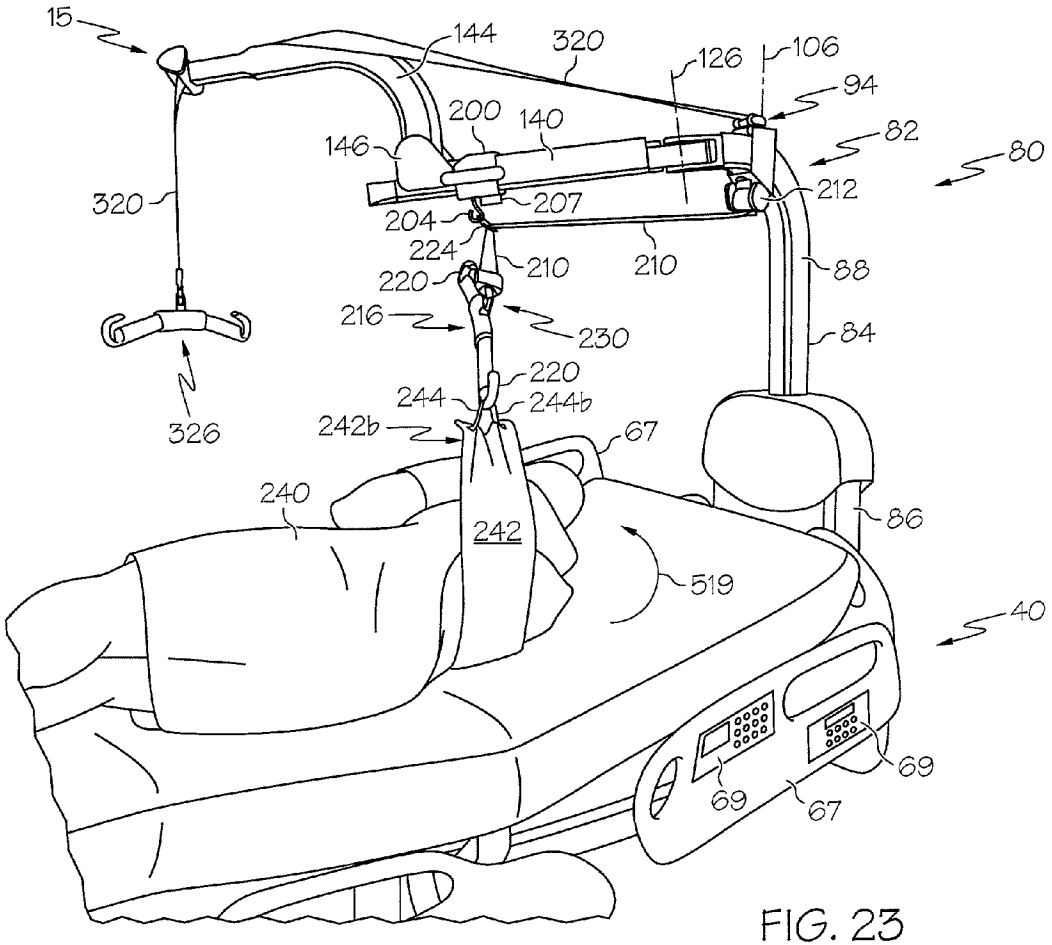
FIG. 23 is a perspective view of the caregiver assist device of FIG. 1 showing the assist belt extending from an inertia reel and through the clip supported on the carriage of FIGS. 9, 11, 13 and coupled to a patient wearing the gown of FIGS. 14-17 so that the patient is turned on the patient support apparatus toward the carriage in response to the elevation of the support surface being lowered.
Figure 24:
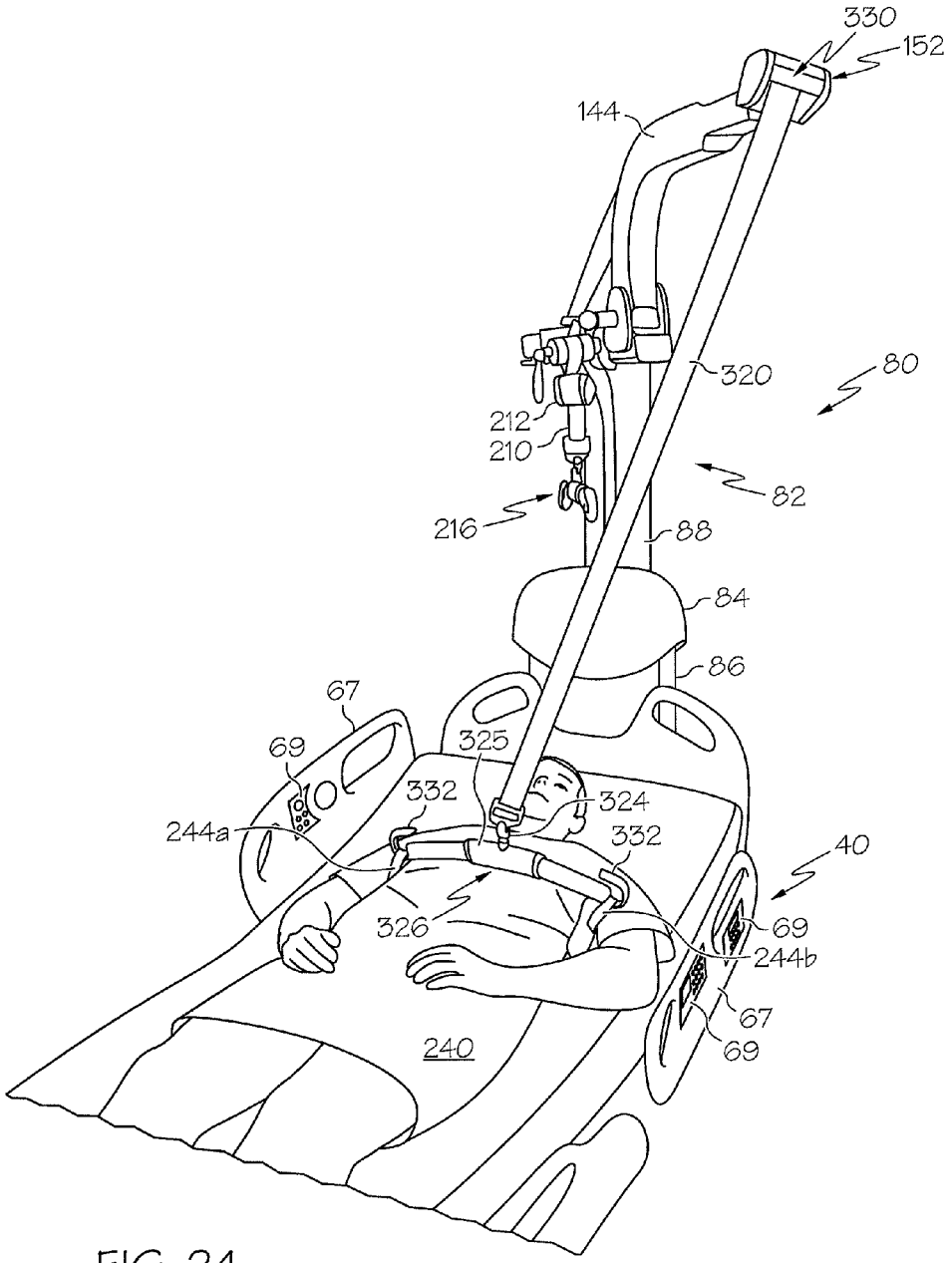
FIG. 24 is a perspective view of the caregiver assist device of FIG. 1 with the boom pivoted relative to the support structure so that the remote end of the boom extends outside the footprint of the patient support apparatus showing the helper belt coupled to the garment of FIGS. 14-17 worn by a patient lying on the patient support apparatus and a force from the constant force spring assembly pulling up on the garment.
Figure 25:
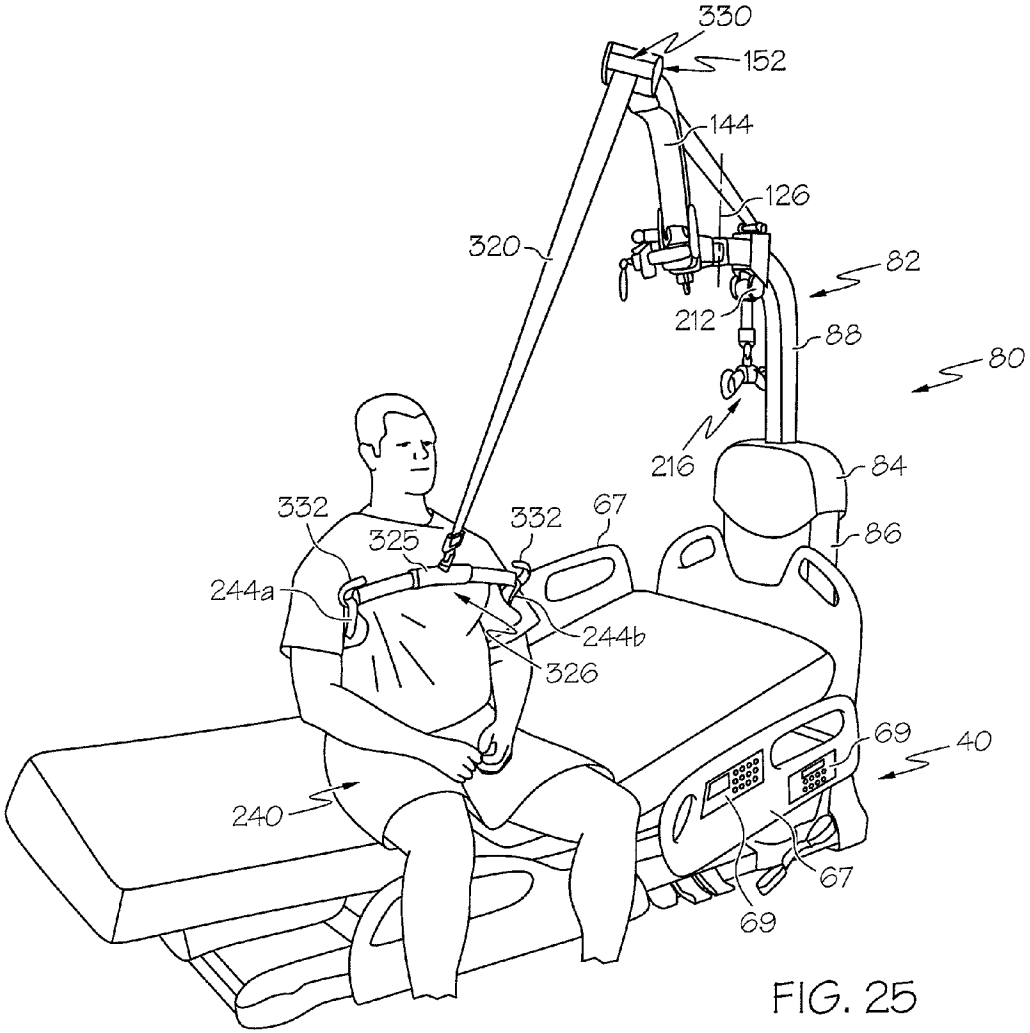
FIG. 25 is a perspective view of the caregiver assist device of FIG. 24 showing the patient sitting on the patient support apparatus and the length of the helper belt being reduced so that the force from the constant force spring assembly continues to pulling up on the garment supporting the patient in the seated position.
Figure 26:
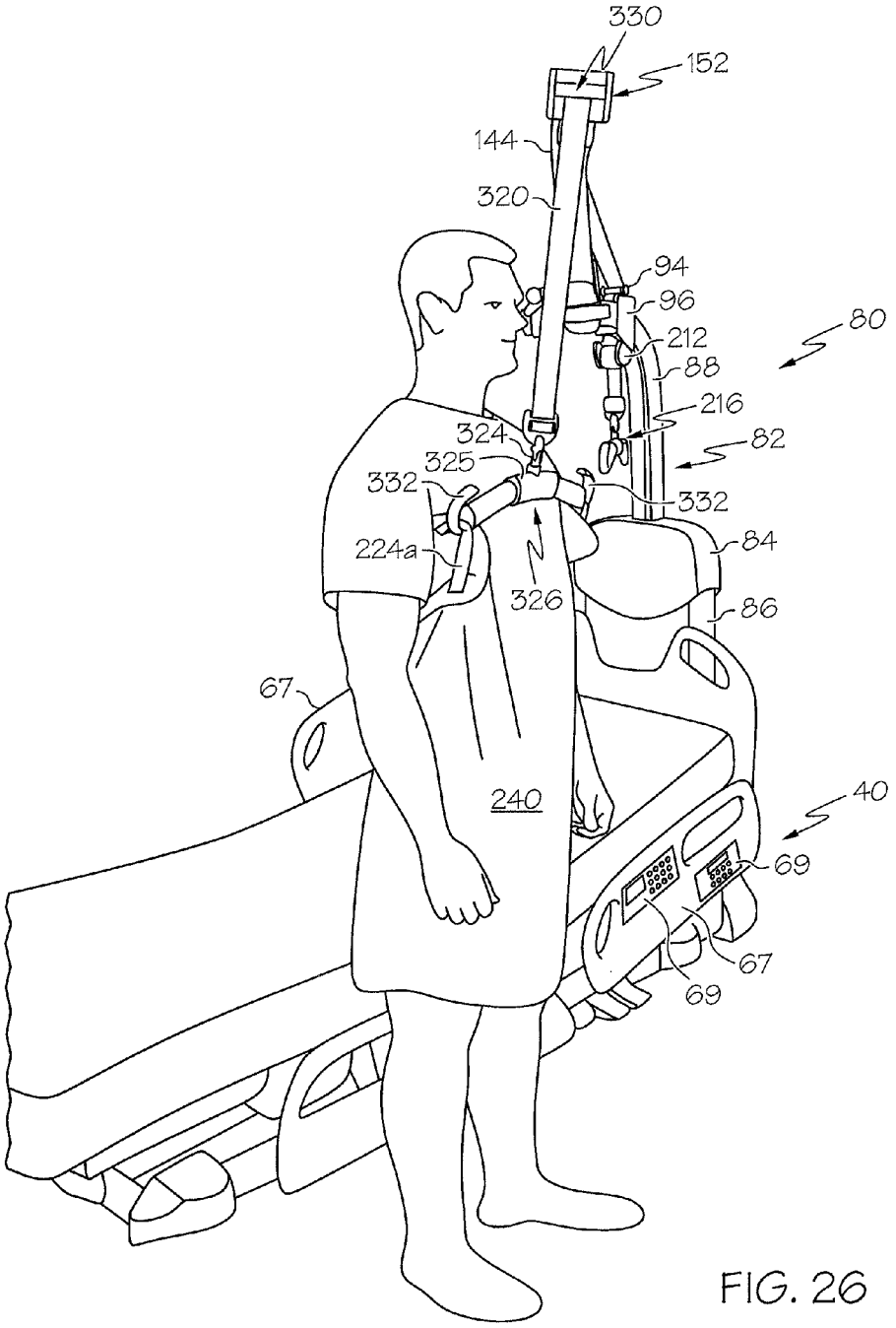
FIG. 26 is a perspective view of the caregiver assist device of FIGS. 24 and 25 showing the patient standing alongside the patient support apparatus and the length of the helper belt being reduced so that the force from the constant force spring assembly continues to pulling up on the garment supporting the patient in the standing position.
Figure 27:
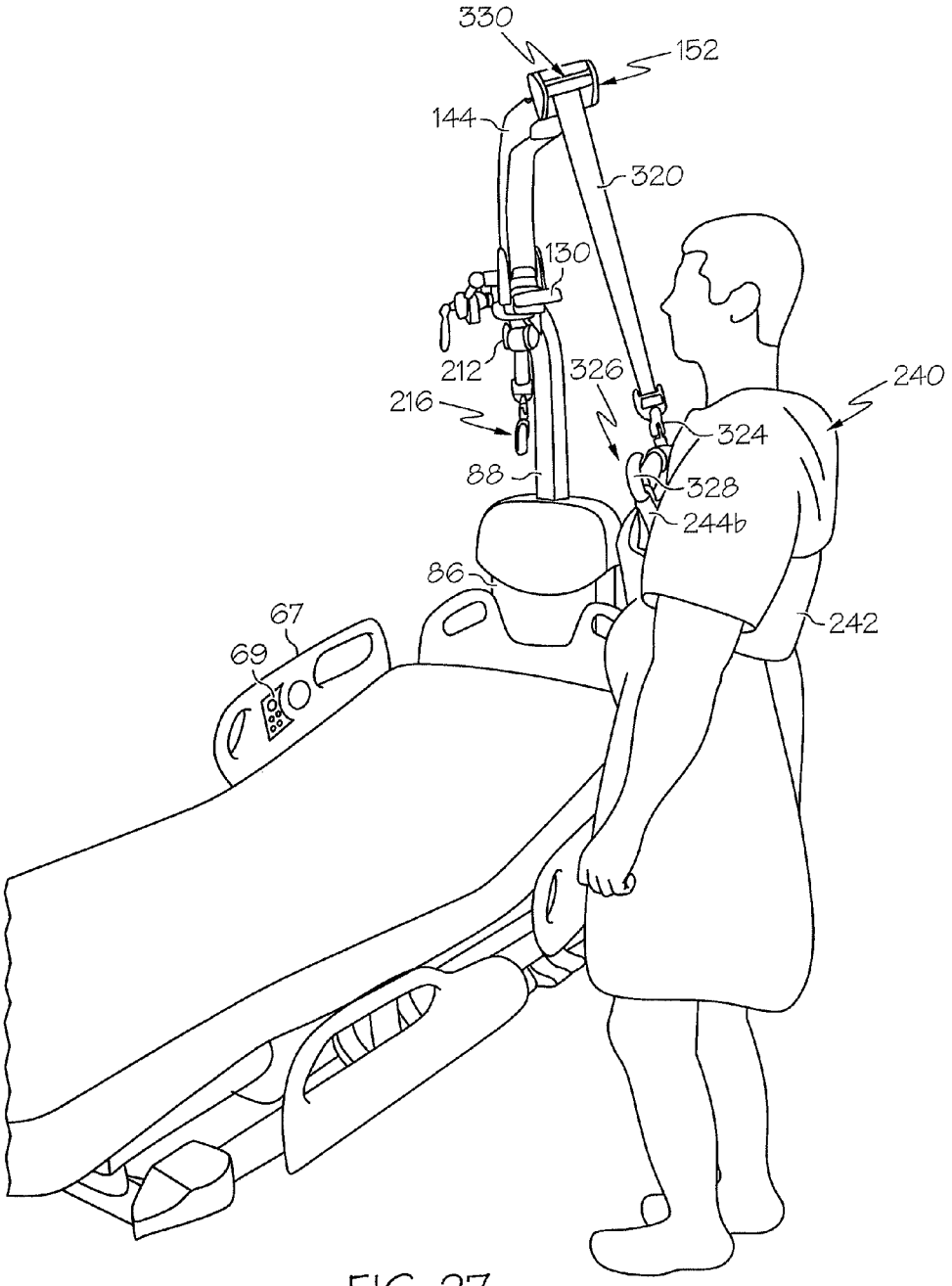
FIG. 27 is a perspective view of the caregiver assist device of FIGS. 24-26 showing the patient turned to face the patient support apparatus the helper belt continuing to support the patient in the standing position.

Device 80 is also configured to pull a patient up in bed 40 as suggested in FIG. 22 and to turn a patient in bed 40 as suggested in FIG. 23. Device 80 includes a movable carriage 200, a reel 212, and an assist belt 210 used in conjunction with bed 40 to move a patient. Carriage 200 travels along frame 82 and establishes an assist belt suspension point 230 above bed 40. Reel 212 is operable to tension assist belt 210 prior to assist belt 210 being used to move a patient on bed 40. An assist force is produced to move the patient on bed 40 when a top surface 72 of a mattress 58 supporting the patient is lowered so that the patient's weight is supported by assist belt 210 causing the patient to move to a position under assist belt suspension point 230.

In practice, a caregiver moves carriage 200 to a position longitudinally or laterally spaced from a weight bearing region 250 of gown 240 worn by a patient in a direction the caregiver desires to move the patient, as seen, for example, in FIG. 22. The caregiver then secures assist belt 210 to carriage 200 and to the patient. Next, the caregiver tightens assist belt 210 by winding it on reel 212. Finally, the caregiver lowers the top surface of mattress 58 until enough of the patient's weight is supported by the assist belt so that the patient slides or rolls in the direction of carriage 200.

Bed

Bed 40 has a head end 42, a foot end 44, a left side 46, and a right side 48 as shown in FIG. 1. Bed 40 includes a base frame 52, an upper frame 54, and a deck 56. Base frame 52 includes a plurality of casters 66 engaging a floor 68 to support bed 40 for movement along floor 68. Upper frame 54 is supported above base frame 52 by a pair of lift arms (not shown) extending between base frame 52 and upper frame 54. Lift arms are pivotable to raise and lower upper frame 54 relative to base frame 52. Deck 56 is articulatable to move to a plurality of positions relative to the upper frame 54 and is supported on upper frame 54 so that the deck is raised and lowered with upper frame 54. Illustratively, deck 56 is shown in a reclined position with a head end deck section raised. A support surface, illustratively a mattress 58 with a top surface 72, is supported on deck 56 and is raised and lowered with deck 56. Additionally, bed 40 includes a barrier, illustratively a head rail 67 with a user input 69 operable by a caregiver for raising and lowering upper frame 54 relative to base frame 52.

Frame

Frame 82 is coupled to and extends above bed 40 to guide helper belt 320 from behind head end 42 of bed 40 as shown, for example, in FIG. 1. Frame 82 includes a support structure 84 and a boom 120. Support structure 84 supports boom 120 cantilevered out from support structure 84. Support structure 84 includes a base portion 86 coupled to base frame 52 of bed 40 and an upper portion 88 extending up from base portion 86. Boom 120 includes a base arm 140 pivotably coupled to upper portion 88 of support structure 84 and an extension 144 pivotably coupled to base arm 140. In the illustrative embodiment, boom 120 is manually pivoted relative to support structure 84. In other embodiments, boom 120 may be pivoted relative to support structure 84 by a powered means.

Figure 2:
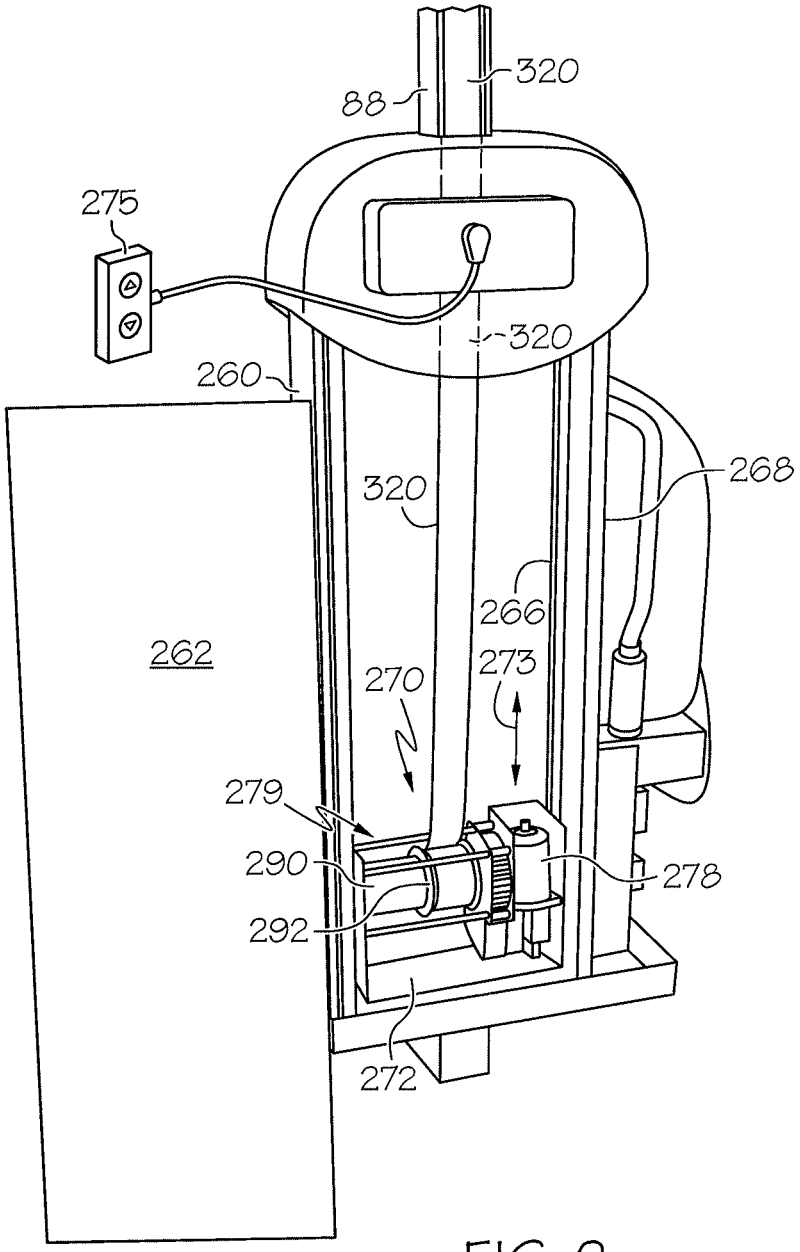
FIG. 2 is a rear detail perspective view of the caregiver assist device of FIG. 1 showing a base portion of the support structure and a constant force spring assembly situated inside the base portion.
Figure 3:
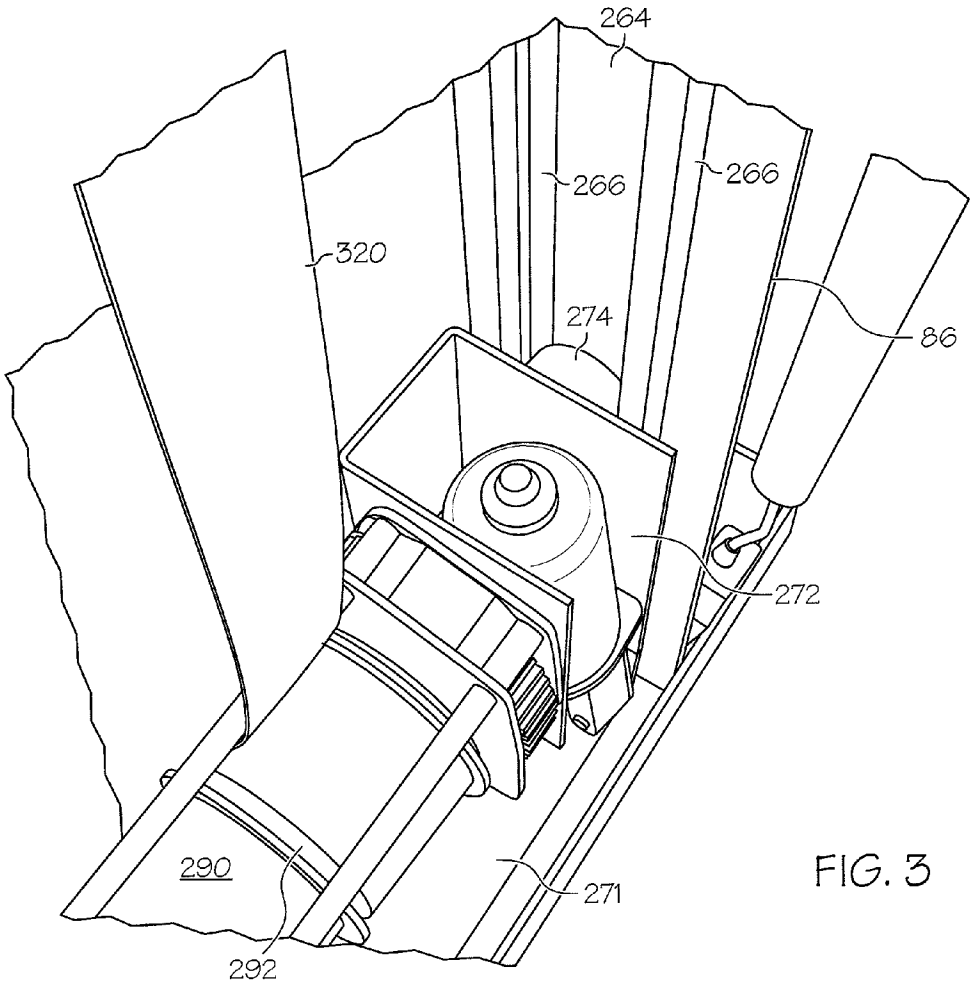
FIG. 3 is a detail perspective view of the caregiver assist device of FIG. 1 looking down in to the base portion of the support structure showing that a carrier of the constant force spring assembly is slidable relative to the base portion of the support structure.

Base portion 86 of support structure 84 forms a cabinet for housing constant force spring assembly 270 and a portion of helper belt 320 as shown in FIGS. 2-5. Base portion 86 includes a left and a right sidewall 260, 268 along with an access panel 262. Left and right sidewalls 260, 268 each include a pair of lips 266 defining channels 264 as shown in FIG. 3. Access panel 262, shown removed in FIG. 2, blocks access to constant force spring assembly 270 when installed on base portion 86.

Figure 11:
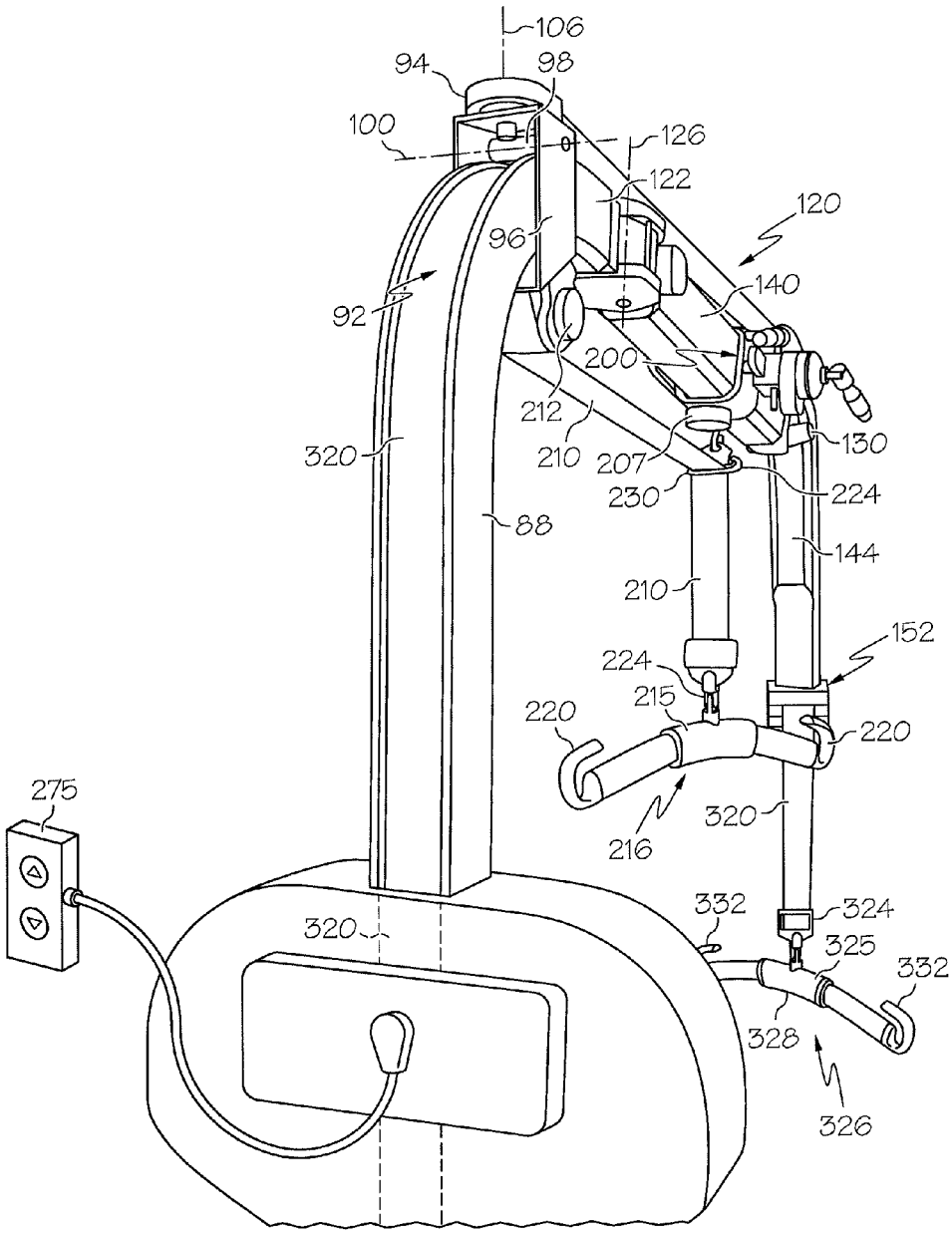
FIG. 11 is a rear perspective view of the caregiver assist device of FIG. 1 showing the extension of the boom pivoted down to the stowed position reducing the height of the caregiver assist device so that the caregiver assist device can pass through low door frames.

Upper portion 88 of support structure 84 is coupled to and extends upwardly from base portion 86 of support structure 84 as shown, for example, in FIG. 1. Upper portion 88 is L-shaped and the forms a channel 92 at the head end of upper portion 88 as shown in FIG. 11. Channel 92 is sized to receive helper belt 320 guiding helper belt 320 up from base portion 86 of support structure 84 as suggested in FIG. 11.

Base arm 140 of boom 120 is coupled to upper portion 88 of support structure 84 for pivotable movement about axis 126 as shown in FIG. 1. Base arm 140 includes a bracket 146 spaced apart from support structure 84 and a lock (not shown) with a release handle 130. The lock is movable between a locked position, blocking movement of base arm 140 relative to support structure 84, and a released position, allowing movement of base arm 140 relative to support structure 84. Handle 130 is coupled to the remote end of base arm 140 and is pivotable relative thereto about an axis 132 as shown in FIG. 1. The lock further includes a band clamp with a cam release and a linkage (not shown) extending through base arm 140 to handle 130. The band clamp and cam release are situated at the junction of the base arm 140 and the support structure 84 and are configured to bias the lock in the locked position. Handle 130 is turned by a user to move the lock from the locked position to the unlocked position so that the user can pivot base arm 140 relative to support structure 84.

Extension 144 of boom 120 is coupled to bracket 146 of base arm 140 so that extension 144 pivots about an axis 148 relative to base arm 140. Extension 144 is L-shaped and moveable between a deployed position, shown in FIG. 1, and a stowed position, shown in FIGS. 9 and 11. In the deployed position, remote end 154 of extension 144 is located above base arm 140 and provides a helper belt suspension location at remote end 154 of extension 144 above base arm 140. In the stowed position, extension 144 is pivoted down as suggested by arrow 195 in FIG. 9 so that remote end 154 of extension 144 is below base arm 140. In the stowed position, extension 144 is low enough to fit through standard size doors.

Figure 8:
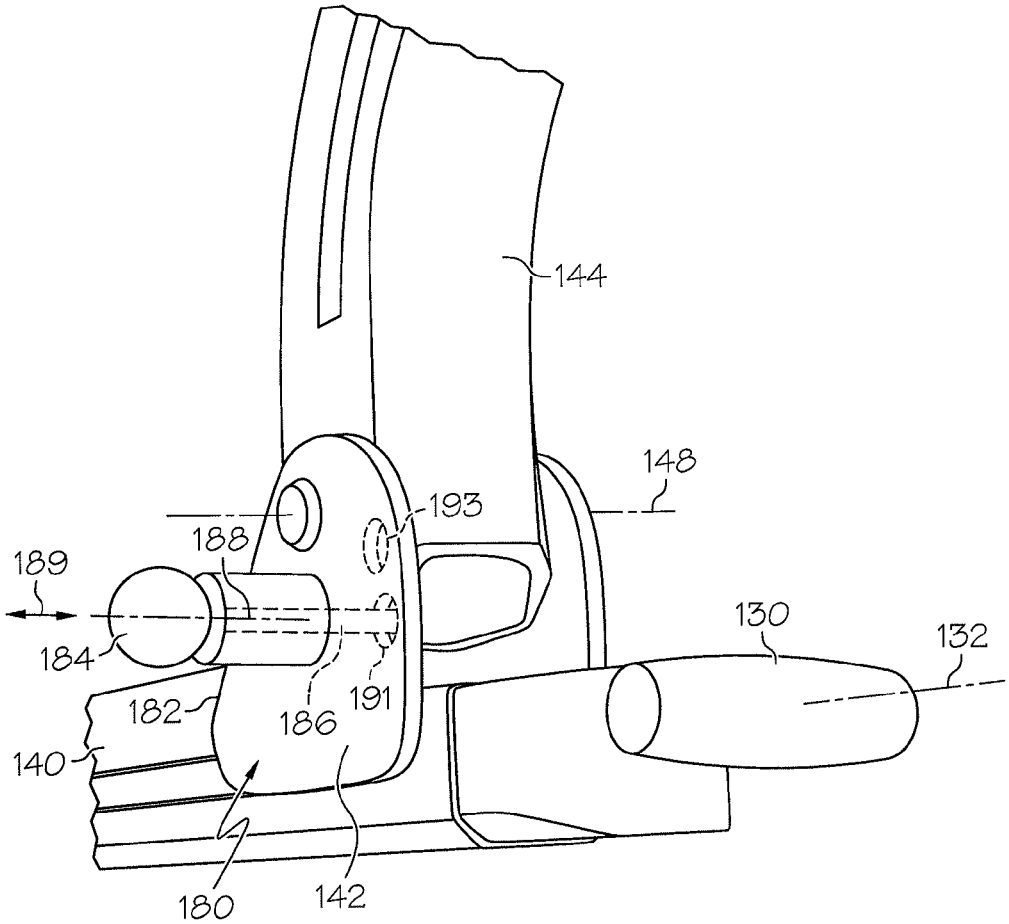
FIG. 8 is a detail perspective view of the caregiver assist device of FIG. 1 showing a plunger lock holding the extension of the boom in a use position relative to the base arm of the boom.

Extension 144 includes a latch 180, shown in FIG. 8, for locking extension 144 in the deployed position or the stowed position. Latch 180 includes a plunger 182 with a handle 184 and a shank 186 extending from handle 184 through bracket 146 and into one of a first hole 191 and a second hole 193 formed in extension 144. First hole 191 is associated with the deployed position of extension 144. Second hole 193 is associated with the stowed position of extension 144. Plunger 182 of latch 180 is spring loaded as is known in the art so that shank 186 is urged to engage one of the holes 191, 193 in extension 144. Latch 180 is movable between a locked position, blocking rotating movement of extension 144 relative to base arm 140, and an unlocked position, allowing movement of extension 144 relative to base arm 140. In the locked position, shank 186 extends into one of the holes 191, 193 formed in extension 144. In the unlocked position, shank 186 is pulled free of holes 191, 193 by a user pulling on handle 184 so that the shank moves along axis 188 as suggested by arrow 189. Thus, extension 144 is locked in the deployed position when shank 186 engages hole 191 of extension 144 and is locked in the stowed position when shank 186 engages second hole 193 of extension 144.

Constant Force Spring Assembly

Figure 4:
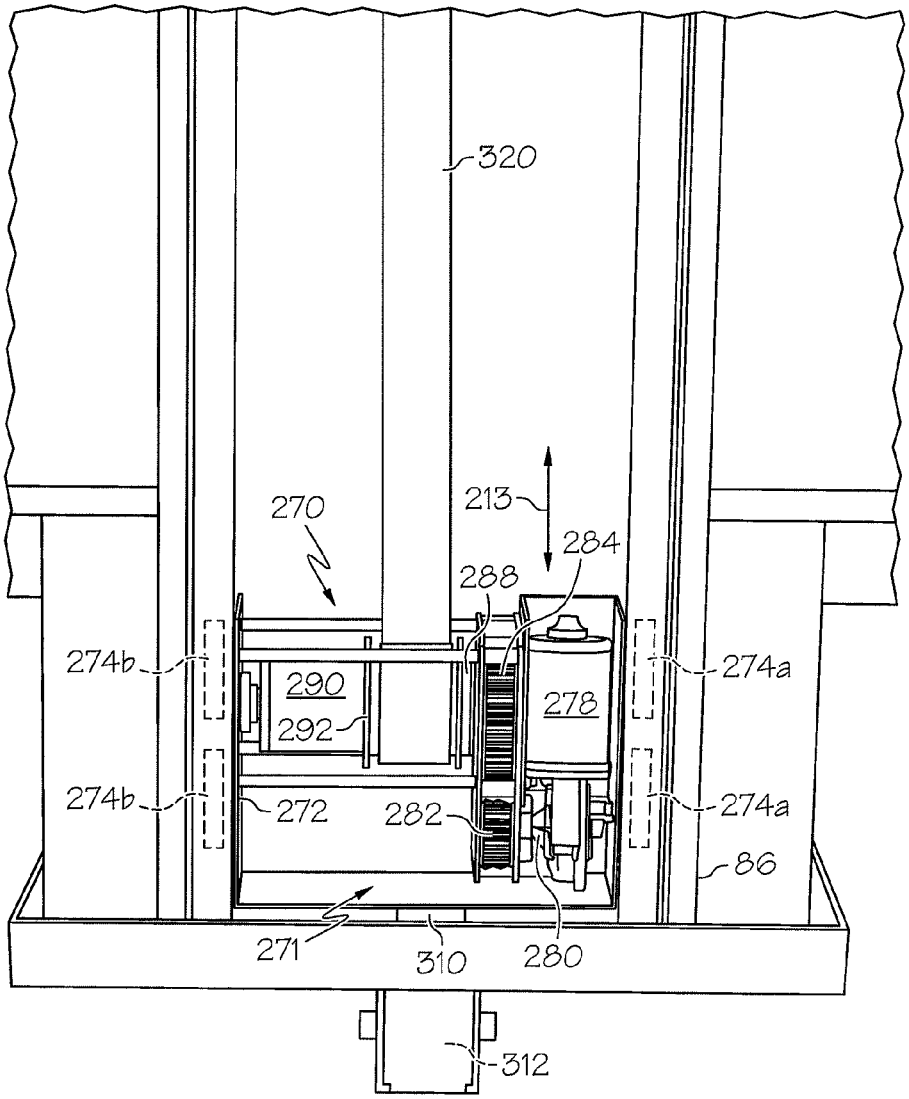
FIG. 4 is a rear detail elevation view of the caregiver assist device of FIG. 1 showing the carrier of the constant force spring assembly near a bottom of the base portion of the support structure with the helper belt extending up from the carrier and a constant force spring extending down from the carrier and secured to the base portion of the support structure.
Figure 5:
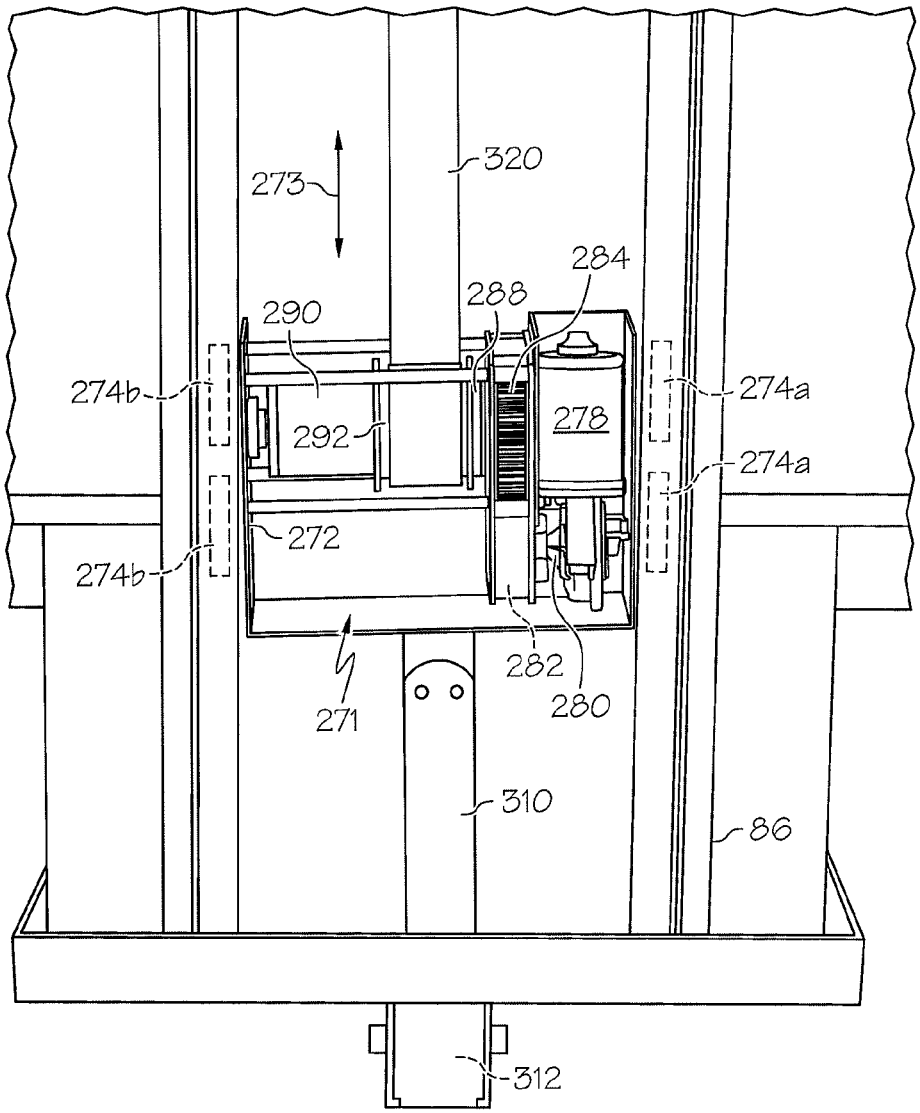
FIG. 5 is a rear detail elevation view of the caregiver assist device of FIGS. 1 and 4 showing the carrier moved up from the bottom of the base portion of the support structure with the helper belt extending up from the carrier and a constant force spring extending down from the carrier.

Constant force spring assembly 270 applies a constant force to helper belt 320 so that a patient is partially supported by the helper belt 320. Constant force spring assembly 270 is housed in base portion 86 of support structure 84 as shown in FIGS. 4 and 5. Constant force spring assembly 270 includes a carrier 271, a tensioning system 279, and a constant force spring 310. Carrier 271 moves along base portion 86 as suggested by arrow 273 in FIGS. 4 and 5 to accommodate extension and retraction of constant force spring 310. Tensioning system 279 is operated by a caregiver to tension helper belt 320 so that the helper force provided by constant force spring 310 is applied to helper belt 320 when a patient supported by helper belt 320 moves beyond the travel of constant force spring 310. Constant force spring 310 applies an approximately constant force to carrier 271 while helper belt 320 is tensioned.

Carrier 271 includes a carrier frame 272, a first pair of wheels 274*a*, and a second pair of wheels 274*b* as shown in FIGS. 3-5. Carrier frame 272 is configured to support tensioning system 279 as suggested in FIGS. 4 and 5. Wheels 274*a*, 274*b* are coupled to left and right sides of carrier frame 272. Wheels 274*a*, 274*b* are trapped in channels 264 of base portion 86 of support structure 84 so that carrier 271 is slidably coupled to base portion 86 of support structure 84.

Tensioning system 279 allows a caregiver to tension helper belt 320 and includes an electric motor 278 with an output shaft 280, a pinion gear 282, a driven gear 284, a rotatable drum 290, and a controller 275, as shown in FIGS. 2-5. Shaft 280 coupled electric motor 278 to pinion gear 282. Pinion gear 282 engages and meshes with driven gear 284. Driven gear 284 is larger than pinion gear 282 so that the gears 282, 284 provide a reduction of the output of motor 278. Driven gear 284 is coupled to rotatable drum 290 and drum 290 turns with driven gear 284. Drum 290 includes a spool 292 that is coupled to helper belt 320 so that helper belt 320 wraps or unwraps from spool 292 as drum 290 is rotated by motor 278. Illustrative controller 275 is wired to the motor 278 and is configured to operate motor 278 in a tightening direction and a loosening direction when a caregiver presses buttons on controller 275. In other embodiments, controller 275 may be wireless or may be incorporated into other controls on or around bed 40 such as user input 69 on head rail 67. Electric motor 278 is illustratively operable to rotate spool 292 to tighten and loosen helper belt 320 but is not operable to lift the weight of patient. In other embodiments, motor 278 may be operable to lift the weight of a patient.

Constant force spring 310 is illustratively a thirty-six inch rolled ribbon of spring steel that is wound around a spindle 312 to provide an approximately constant force over its range of motion as suggested by FIGS. 4 and 5. In the illustrative embodiment, constant force spring 310 produces a helper force of about forty pounds. In other embodiments constant force spring may produce between twenty and forty pounds of force. In still other embodiments, constant force spring 310 may produce a helper force less than the typical weight of a patient. In some embodiments, constant force spring 310 may be another device providing constant force, a coil spring with a low spring coefficient, a coil spring, a gas spring, or the like. Constant force spring 310 is secured at one end to base portion 86 of support structure 84 and to carrier frame 272 at the opposite end.

Constant force spring assembly 270 has a neutral state in which the carrier is at the bottom of the cabinet and nearly all of the spring band is coiled around its spindle in a relaxed state, as suggested in FIGS. 2 and 4. Constant force spring assembly 270 also has a charged state in which the carrier 272 is displaced from the bottom of the base portion 86 of support structure 84 and at least a portion of the constant force spring 310 is uncoiled from the spindle 312, as suggested in FIG. 5. Carrier 272 displacement occurs in response to a patient force exceeding the helper force being applied to the second end of the helper belt 320. The helper force is the force rating of the constant force spring 310 plus the weight of the carrier 272 and the equipment mounted thereon (e.g. the motor, shafts, gears) however in the interest of simplicity the remainder of this discussion assumes that the forces attributable to component weights are negligible in comparison to the force exerted by the constant force spring 310. The displacement increases as long as the patient force exceeds the helper force. If the patient force equals the helper force, no change in displacement occurs. If the patient force is reduced to less than the helper force, carrier 272 displacement decreases until carrier 272 returns to the bottom of the base portion 86 of support structure 84.

Helper Belt Guides

Device 80 also includes a proximal guide 94 and a remote guide 152 as shown in FIG. 1. Proximal guide 94 receives helper belt 320 at the top of support structure 84 and guides helper belt 320 to extend over boom 120. Remote guide 152 is coupled to the remote end of extension 144 and guides helper belt 320 down from boom 120 toward a patient as suggested in FIGS. 24-28.

Figure 6:
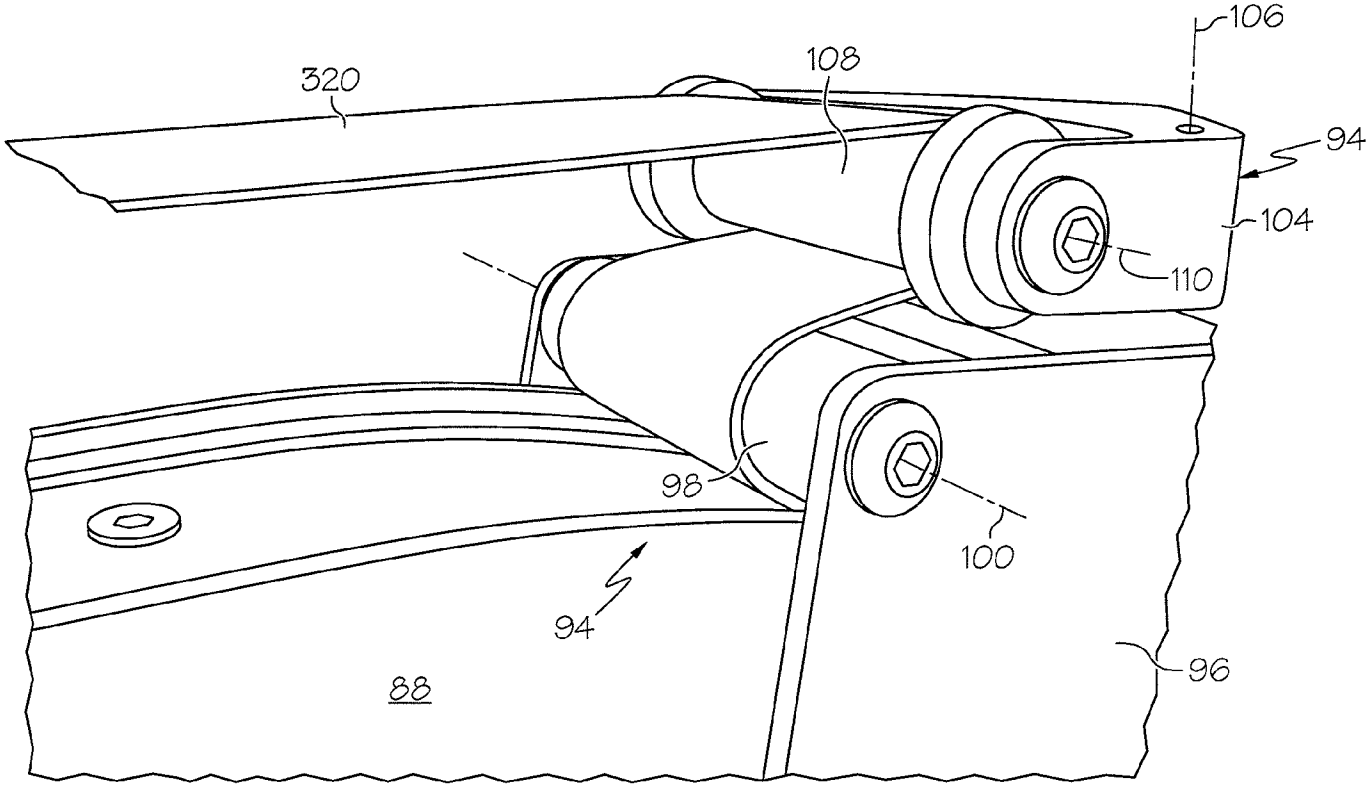
FIG. 6 is detail perspective view of the caregiver assist device of FIG. 1 showing a proximate belt guide with a yoke, a yoke roller, and a support roller for guiding the helper belt, wherein the yoke and the yoke roller are pivotably coupled to the support structure.

Proximal guide 94 is coupled to upper portion 88 of support structure 84 and is configured to guide helper belt 320 from the top of support structure 84 to extend over boom 120 as boom 120 is pivoted relative to support structure 84 as suggested, for example, in FIGS. 22-23. Proximal guide 94 includes a bracket 96 with a bracket roller 98 and a yoke 104 with a roller 108 as shown in FIG. 6. Bracket roller 98 engages helper belt 320 as helper belt 320 exits channel 92 of support structure 84 as suggested in FIGS. 6 and 11. Bracket roller turns about axis 100 and yoke roller 108 turns about an axis 110 as suggested in FIG. 6 so that helper belt 320 can be lengthened or shortened. Yoke roller 108 engages helper belt 320 as helper belt exits bracket roller 98 and directs helper belt 320 along boom 120. Yoke 104 and yoke roller 108 are pivotable relative to bracket 96 about an axis 106 as suggested in FIG. 6. Yoke 104 and yoke roller 108 pivot to follow boom 120 so that helper belt 320 is guided away from support structure 84 at the same angle as boom 120 relative to support structure 84 as suggested by FIG. 23.

Figure 7:
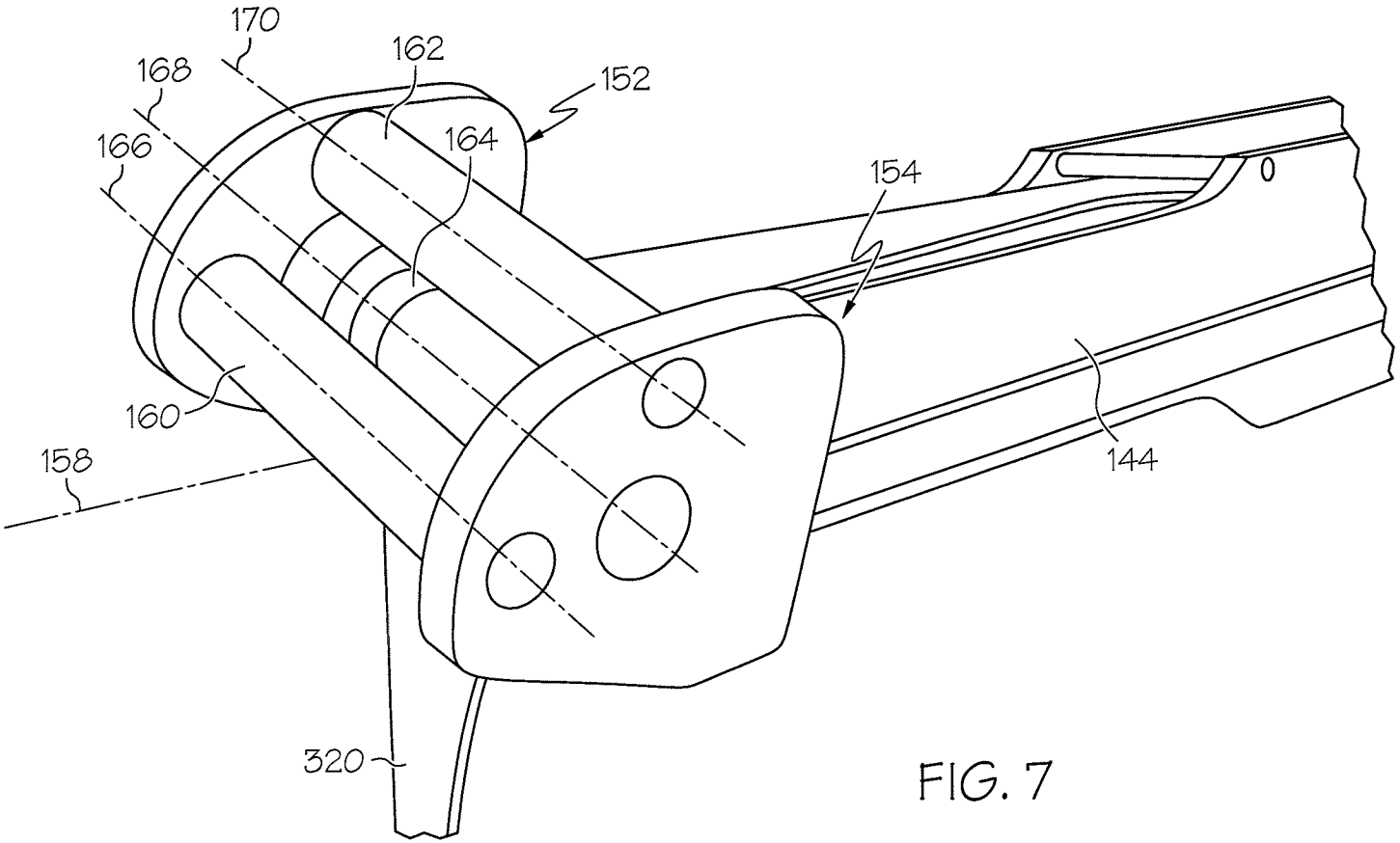
FIG. 7 is a detail perspective view the caregiver assist device showing a remote belt guide with three rollers for guiding the helper belt, wherein the remote belt guide is pivotably coupled to the boom.

Remote guide 152 is configured to guide helper belt 320 down from boom 120 toward a patient as a patient moves relative to boom 120 as suggested in FIGS. 24-28. Remote guide 152 pivots relative to extension 144 about an axis 158 as suggested by FIG. 7 guiding helper belt 320 from boom 120 toward a patient on or around bed 40. Axis 158 extends substantially horizontally along extension 144. Remote guide 152 includes a rollers 160, 162, 164 turning about axes 166, 168, 170, respectively, as suggested by FIG. 7 to prevent helper belt from escaping remote guide 152.

Helper Belt

Helper belt 320 is illustratively a cloth belt with a first end and a second end. Helper belt 320 is secured at its first end to spool 292 of constant force spring assembly 270 can be lengthened or shortened by unwinding or winding helper belt 320 on spool 292. Helper belt 320 extends up from constant force spring assembly 270 and along upper portion 88 of support structure 84 in channel 92 of upper portion 88 as suggested in FIG. 11. Helper belt 320 is then guided by proximal guide 94 in the direction of boom 120 extending along boom 120 to remote guide 152 where helper belt 320 is guided down from boom 120 to a patient as suggested in FIGS. 24-28.

Helper Holder

A helper holder 326 is included in device 80 and is operable to secure a patient to helper belt 320 as shown in FIGS. 24-28. Helper holder 326 is coupled to the second end of helper belt 320 and includes a joint clip 324, a handle bar 328, and a pair of hooks 332. Joint clip 324 is a universal joint secured to handle bar 328 at a central location 325 and is configured to couple to helper belt 320. Handle bar 328 extends outwardly from joint clip 324 and provides handles for a patient or caregiver to use in positioning helper holder 326. Pair of hooks 332 are spaced apart from one another at either end of handle bar 328 as shown in FIG. 11.

Carriage

Carriage 200 is slidably coupled to base arm 140 of boom 120 to provide a connection point for a variety of accessories for supporting and moving a patient as shown in FIGS. 1, 9, 22, and 23. Carriage 200 includes a hook 204, a pair of accessory rails 206 on left and right sides of carriage 200, and a carriage lock 207. Accessory rails 206 are configured to support standard patient support devices such as support arm 211 with armboard 213 shown in FIG. 1. Carriage lock 207 is illustratively a bolt with a knob that is turned by a user between a locked position, blocking movement of carriage 200 relative to base arm 140, and a released position, allowing slidable movement of carriage 200 relative to base arm 140.

Figure 9:
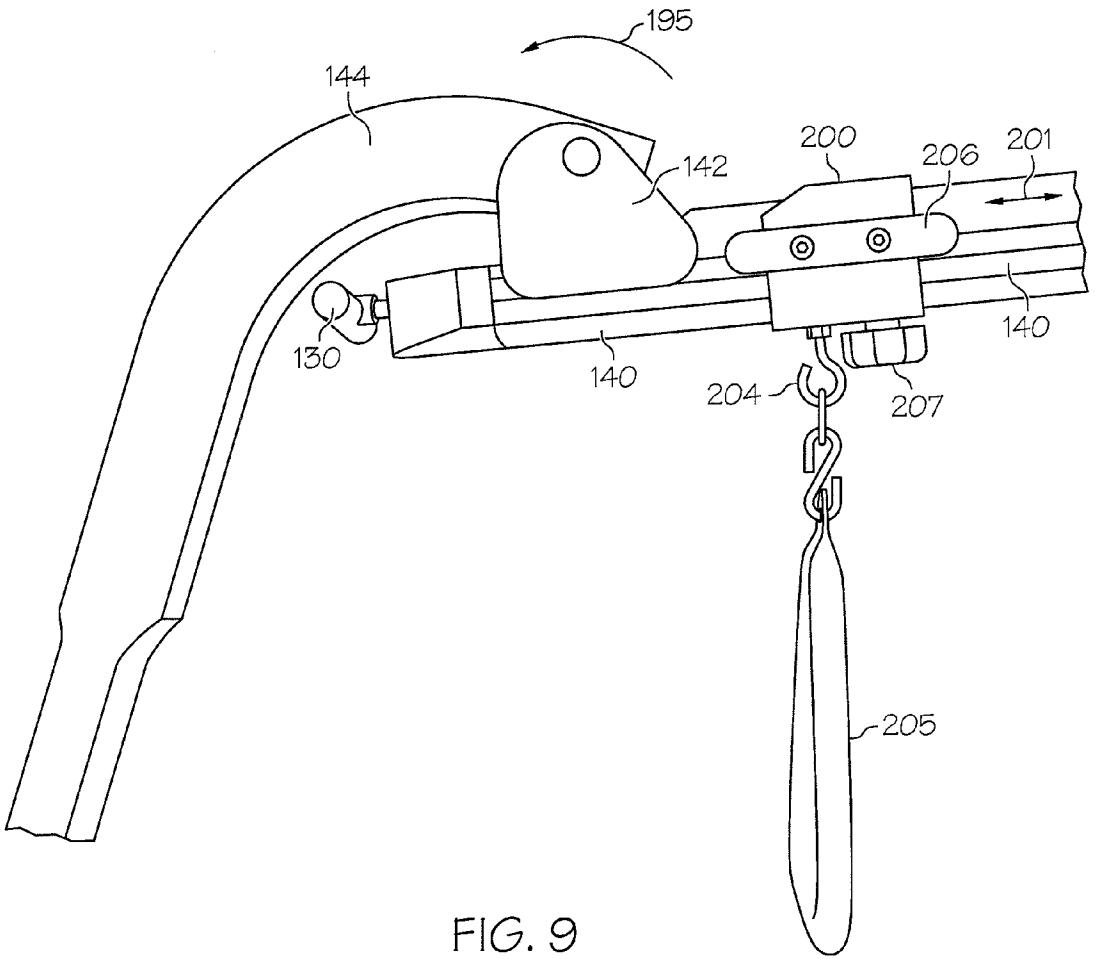
FIG. 9 is an elevation detail view of the caregiver assist device of FIG. 1 showing a portion of the boom including a base arm of the boom, an extension of the boom pivotably coupled to an end of the base arm, and a carriage with a hook slidably coupled to the base arm of the boom.

Hook 204 of carriage 200 extends down from carriage 200 as shown in FIG. 9. Hook 204 can support patient powered movement support devices such as a triangular pull-up bar 205, shown in FIG. 9, or an arched pull-up handle coupled to hook 204 via assist belt 210, shown in FIG. 1. Hook 204 can also support assist belt 210 while a first end of assist belt 210 is secured to reel 212 as suggested in FIGS. 11 and 13.

Reel

Reel 212 of device 80 is illustratively an inertia reel operable by a caregiver to lengthen or shorten assist belt 210 by increasing or decreasing the amount of assist belt 210 wound around reel 212. Reel 212 is configured to allow the belt to be wound onto it without resistance, but reel 212 locks if the belt is unwound too quickly, thereby prohibiting further unwinding of the belt. Unwinding can be resumed by causing or allowing the belt to wind onto the reel slightly, then pulling the belt again in the "unwind" direction. In other embodiments, reel 212 may be motorized for increasing and decreasing the length of assist belt 210 wound on reel 212. In still other embodiments, reel 212 may be locked from winding or unwinding assist belt 210 from reel 212 by know locking mechanisms.

Reel 212 is illustratively secured to bracket 96 of proximal belt guide 94 so that reel 212 is secured to support structure 84 as shown in FIG. 1. Thus, when the first end of assist belt 210 is secured to reel 212 and assist belt 210 is supported by carriage 200, assist belt 210 runs along boom 120 between reel 212 and carriage 200 as shown in FIG. 11. In other embodiments, reel 212 may be secured to other parts of frame 82, carriage 200, or bed 40.

Assist Belt

Figure 13:
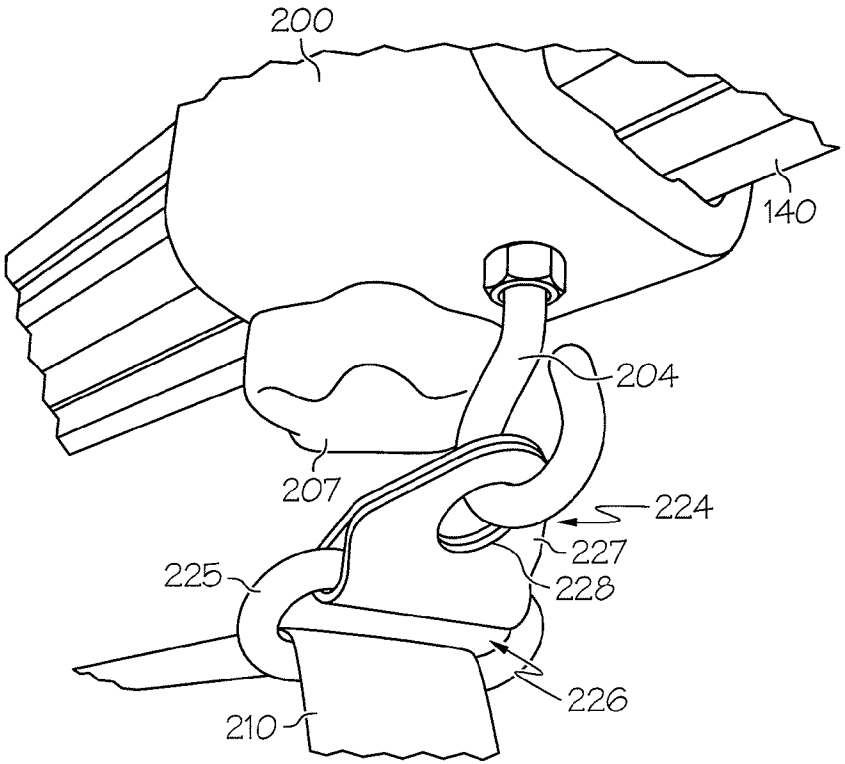
FIG. 13 is a detail perspective view of the clip of FIG. 12 hanging from a carriage slidably coupled to the boom so that the assist belt is supported by the boom.
Figure 12:
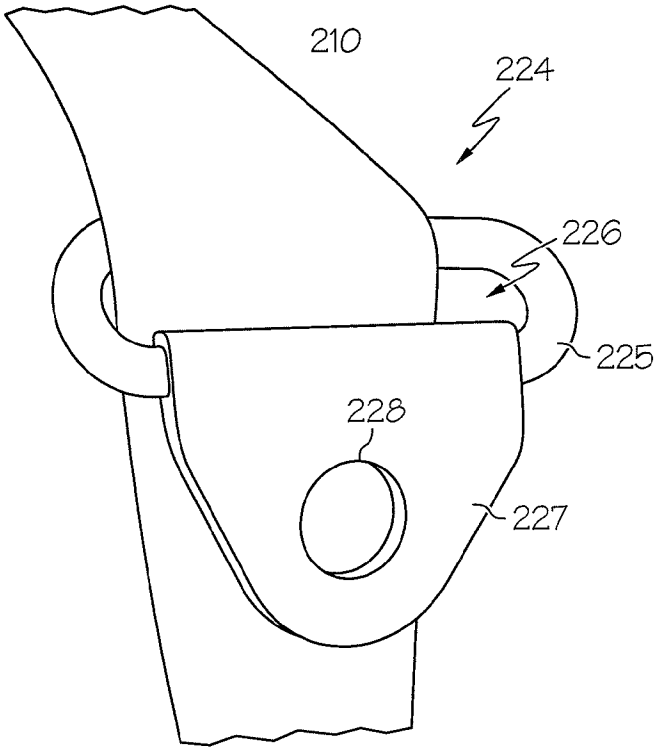
FIG. 12 is a detail perspective view of a clip of FIGS. 10 and 11 coupled to the assist belt and having a hole formed in the clip.

Assist belt 210 includes a clip 224 slidably movable between the first end and the second end of assist belt 210. Clip 224 includes a belt ring 225 with an oblong opening 226 and a triangular catch with a hole 228 a shown in FIGS. 12 and 13. Assist belt 210 moves between a deployed position and a storage position. In the deployed position, clip 224 of assist belt 210 is coupled to carriage 200 by hook 204 of carriage 200 is passing through hole 228 of clip 224 as shown in FIGS. 11 and 13. In the stored position, clip 224 is released from carriage 200 and assist belt is partially or fully wound on reel 212 out of the way of caregivers and patients as suggested by FIG. 10.

Assist Holder

Figure 10:
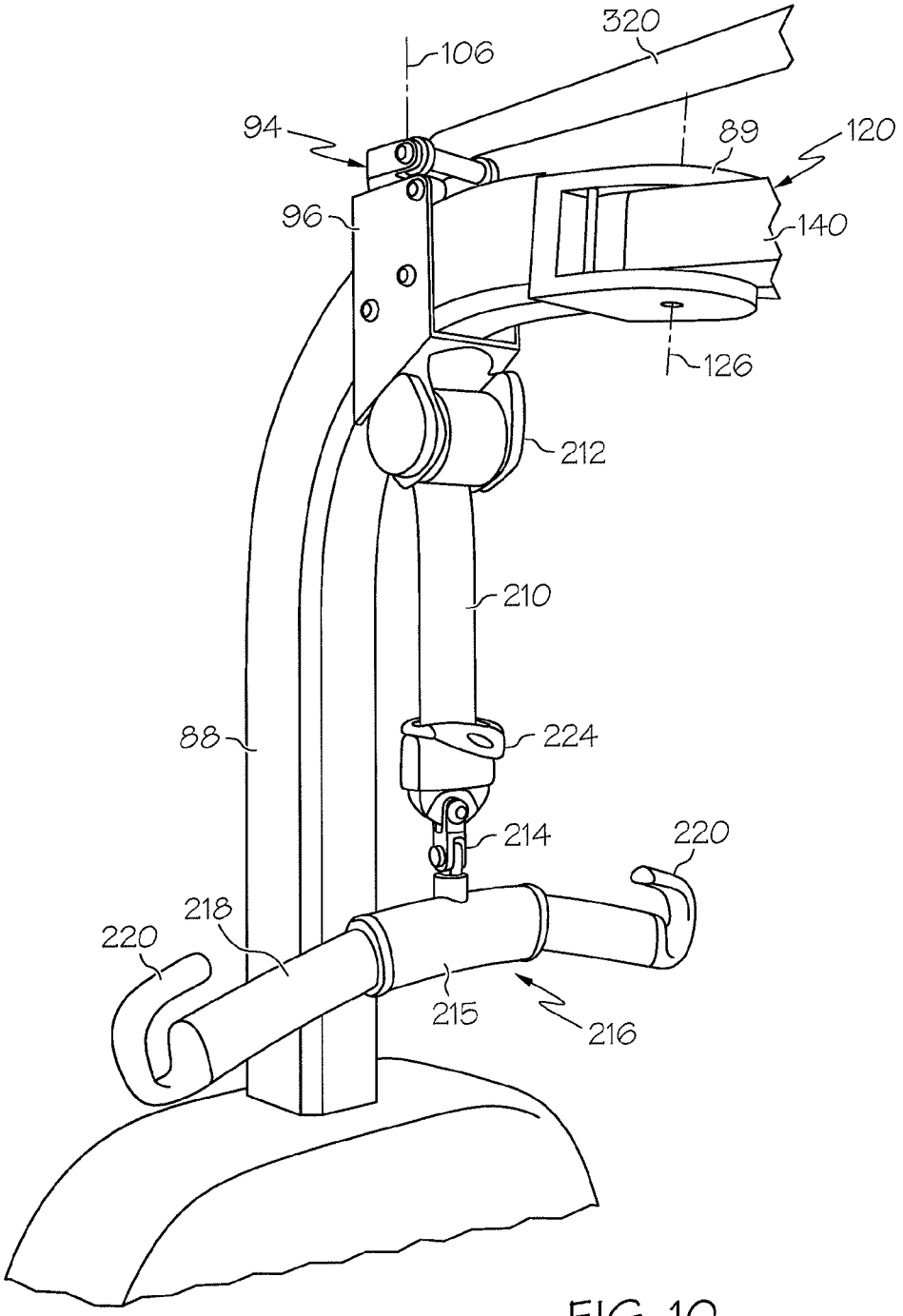
FIG. 10 is a perspective detail view of a portion of the caregiver assist device of FIG. 1 showing an upper portion of the support structure extending up from a base portion of the support structure, an inertia real coupled to the upper portion of the support structure, and an assist belt with a clip extending down from the inertia reel to support a holder with a pair of hooks.

An assist holder 216 is illustratively included in device 80 and is substantially similar to helper holder 326. Assist holder 216 is coupled to the second end of assist belt 210 and includes a joint clip 224, a handle bar 218, and a pair of hooks 220. Joint clip 214 is a universal joint secured to handle bar 218 at a central location 215 and is configured to couple to assist belt 210. Handle bar 218 extends outwardly from joint clip 214 and provides handles for a patient or caregiver to use in positioning assist holder 216. Pair of hooks 220 are spaced apart from one another at either end of handle bar 218 as shown in FIG. 10.

Gown

Figure 14:
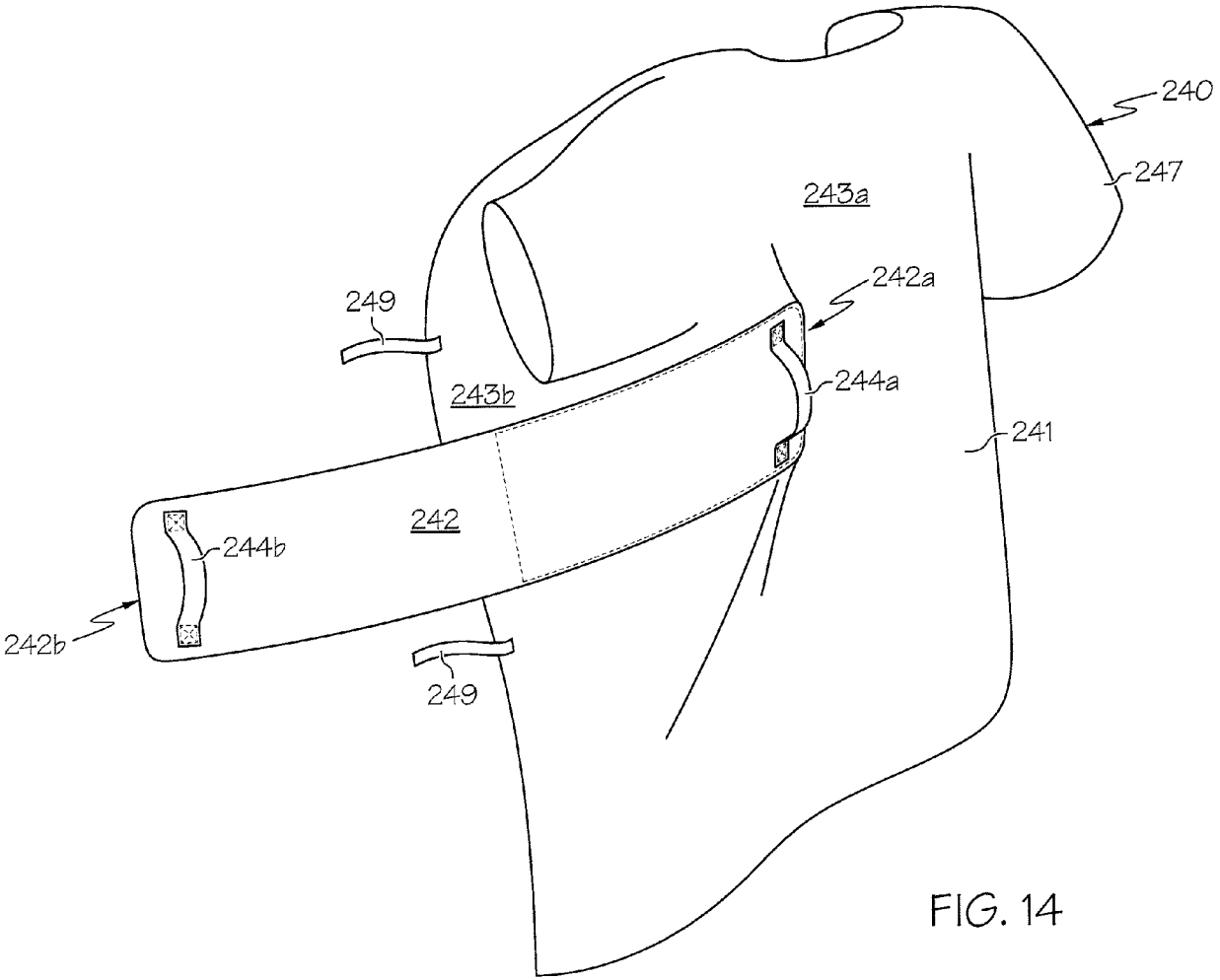
FIG. 14 is a perspective view of a gown for use with the caregiver assist device of FIG. 1 showing the gown including a shirt, a strap secured at one end to the shirt, and a pair of loops coupled at either end of the strap.
Figure 15:
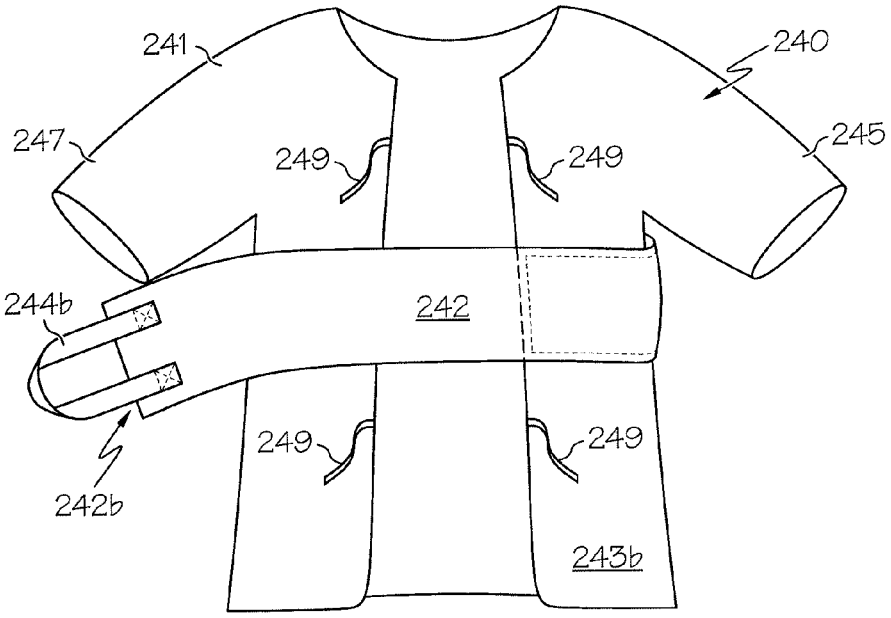
FIG. 15 is a back elevation view of the gown of FIG. 14 showing the strap being wrapped around a back of the shirt.
Figure 16:
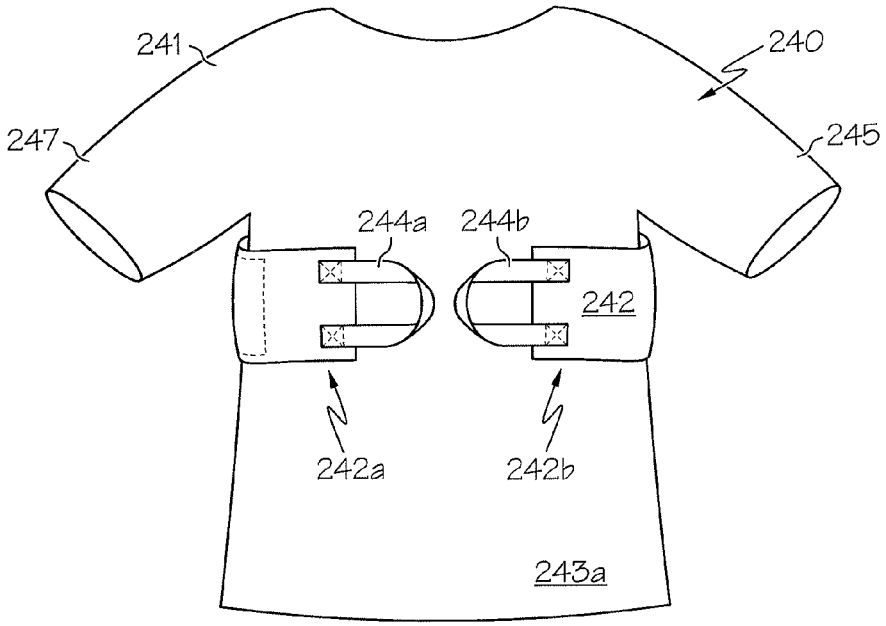
FIG. 16 is a front elevation view of the gown of FIGS. 14 and 15 showing the strap wrapped completely around the shirt for use with the caregiver assist device of FIG. 1.
Figure 17:
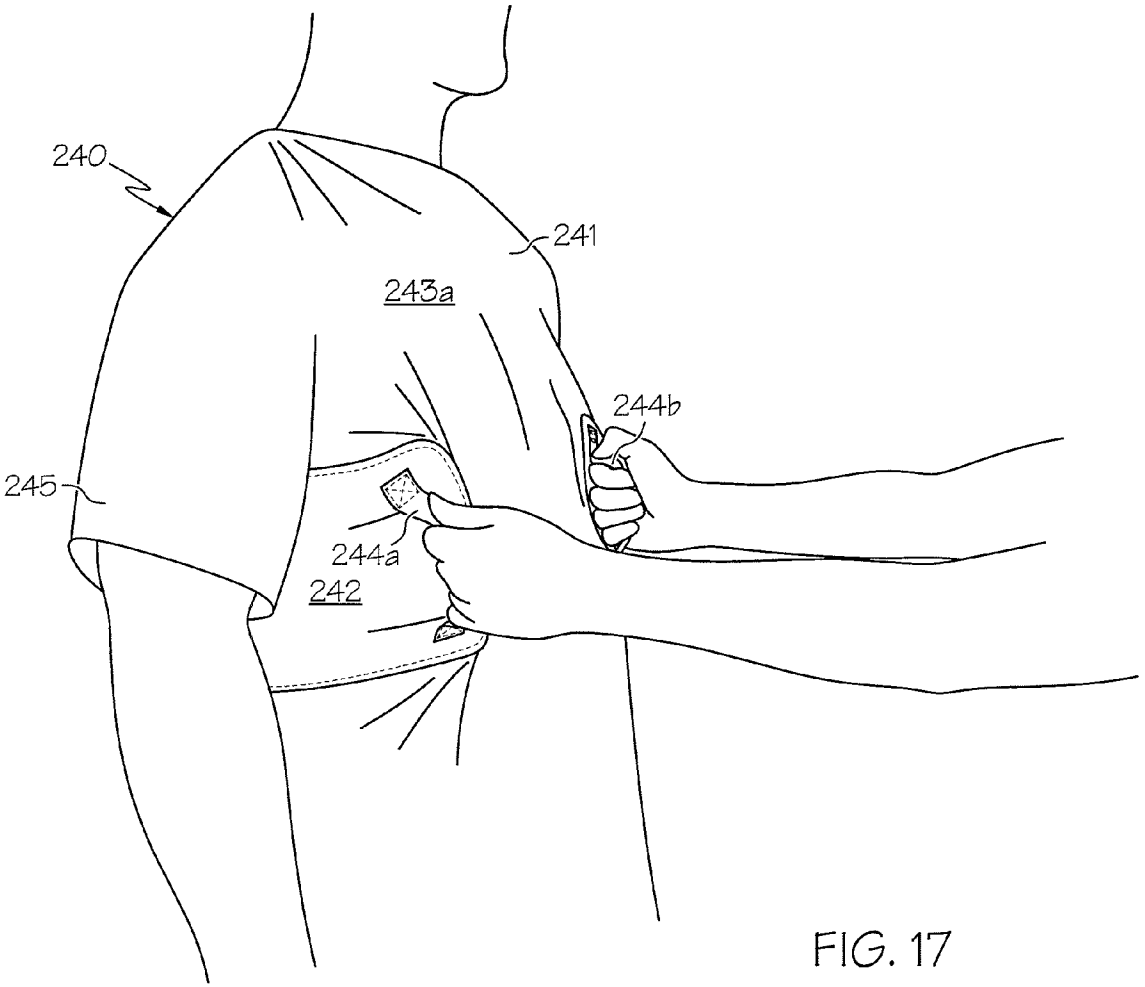
FIG. 17 is a perspective view of the gown of FIGS. 14-16 being worn by a patient with a caregiver pulling on the loops of the gown to move the patient.

Gown 240 is configured to be worn by a patient as suggested in FIG. 17. Gown 240 includes a shirt 241, a pair of sleeves 245, 247, and a strap 242 as shown in FIGS. 14-16. Shirt 241 has a front side 243*a* and a back side 243*b* that opens to allow a patient to put on gown 240 as suggested in FIG. 14. Strap 242 has a first end 242*a* that is secured to shirt 241 and a second end 242*b* that extends out from a side of shirt 241. Strap 242 also includes a pair of loops 244*a*, 244*b* secured to the first and second ends 242*a*, 242*b* of strap 242, respectively. In use, second end 242*b* of strap 242 is passed around back side 243*b* of shirt 241 as suggested by FIG. 15 and then further wrapped around shirt 241 so that second end 242*b* and loop 244*b* are located at the front side 243*a* of shirt 241 as shown in FIG. 16. With both loops 244*a*, 244*b* located on the front side 243*a* of shirt 241, strap 242 can be used by a caregiver to support or move a patient. Loops 244*a*, 244*b* are configured to be spaced apart to engage the pair of hooks 220 of assist holder 216 or to engage the pair of hooks 332 of the helper holder 326 no matter the size of shirt 241.

Gown 240 is suitable for extended wear by the occupant and therefore differs from slings customarily used in conjunction with patient lift devices, but which are not garments intended for long term wear. When worn by a patient, the ends 242*a*, 242*b* of strap 242 and the loops 244*a*, 244*b* are approximately at the patient's chest level and are laterally offset from the patient's saggital anatomic plane. Gown 240 is patient specific or patient-centric because any individual garment would be associated with the patient rather than being dedicated for use only with a specific individual assist device. In other words, any gown 240 selected from an inventory would be compatible with and interoperable with any individual assist device.

Figure 18:
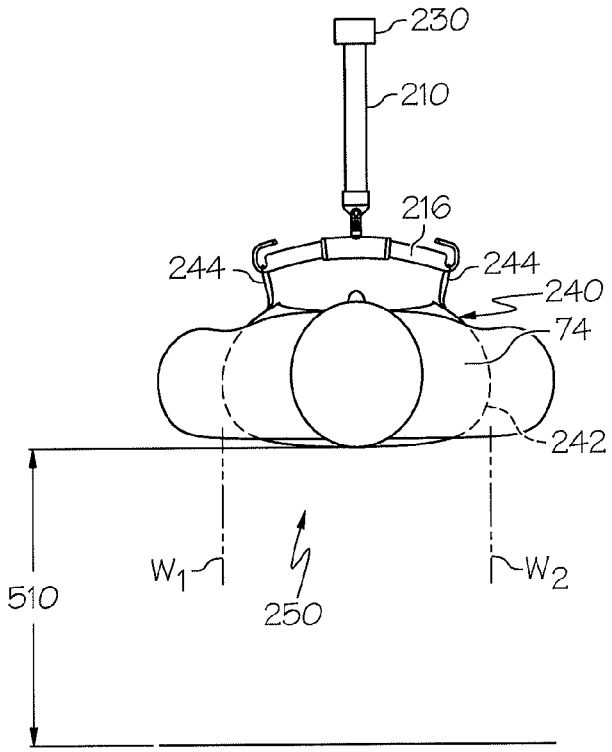
FIG. 18 is a head end elevation view of a patient wearing the gown of FIGS. 14-17 showing the first and the second loops of the gown engaged by a holder of the caregiver assist device and suggesting the lateral dimension of a weight bearing area formed by the strap of the gown.
Figure 19:
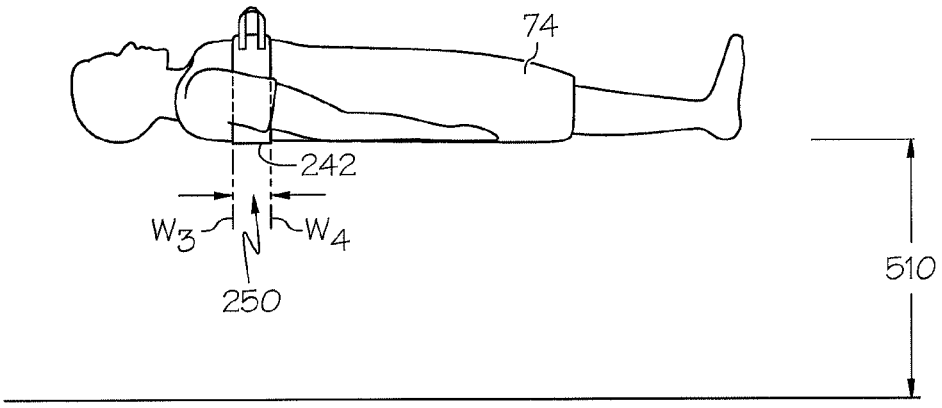
FIG. 19 is a side elevation view of a patient wearing the gown of FIGS. 14-17 suggesting the longitudinal dimension of a weight bearing area formed by the strap of the gown.

Gown 240 defines a weight bearing region 250 when worn by a patient as suggested in FIGS. 18 and 19. A first side w1 and a second side w2 of a patient define the lateral edges of weight bearing region 250 as shown in FIG. 18. A top end w3 and a bottom end of strap 242 define the longitudinal edges of weight bearing region 250 as shown in FIG. 19. Helper or assist forces applied to a patient through loops 244*a*, 244*b* of gown 240 are applied to the patient in weight bearing region 250.

Patient Mobility Support

Device 80 is operable to provide patient mobility support by applying the helper force provided by the constant force spring 310 to a patient on or around bed 40 as suggested by FIGS. 24-28. Constant force spring assembly 270 applies a helper force that is less than a patient's weight to the patient in at least a partially upward direction, thereby counterbalancing a portion of the patient's weight. The helper force is produced mainly by constant force spring 310 that has a range of motion thereby providing the helper force evenly when the patient moves either on his own or with the help of a caregiver so long as he stays within the constant force spring 310 range of motion. Thus, a patient secured to helper belt 320 can move around bed 40 with the helper force lifting a portion of the patient's weight up toward frame 82 with the reduced effective weight making movement easier for the patient or the caregiver helping the patient.

In practice, the patient puts on gown 240 if he's not already wearing it. The caregiver rotates boom 120 about axis 126 to move the suspension location defined by remote guide 152, to a selected location laterally offset from the weight bearing location 250 associated with the patient and at an elevation higher than that of the support surface 58 as suggested in FIG. 24. The positioning of suspension location 330 is consistent with a direction of intended movement of the patient and/or the location of the patient's destination. Typically, suspension location 330 would be outside a bed "footprint" represented by the projection of the bed onto the floor, the caregiver operates electric motor 278 in an extend direction to unwrap enough of helper belt 320 from spool 302 to enable attachment of the helper bar hooks 332 to the garment loops 244*a*, 244*b*. The caregiver then takes up any residual slack in helper belt 320, or at least as much of the slack as is possible to take up, thereby securing the patient to suspension location 330. In the illustrated embodiment this is accomplished by operating the motor in the opposite or retract direction, causing any excess belt to wrap around spool 302. The above steps need not be carried out in any particular order, however as a practical matter the step of taking up slack in helper belt 320 will be done last because the presence of slack facilitates the other steps.

The helper force is then applied to the patient at patient weight bearing location 250. The helper force originates at constant force spring assembly 270 and is approximately equal to the force produced by constant force spring 310. The helper force is used to support the patient as the patient moves from the supine position shown in FIG. 24 to a sitting position shown in FIG. 25, and then to the standing position shown in FIG. 26. The helper force is applied by operating motor 278 in the retract direction to further wrap helper belt 320 onto its spool 292. Because a section of helper belt 320 extends from helper holder 326 toward helper belt suspension location 330, the helper force is also directed toward that location. Once helper belt 320 is wrapped sufficiently on spool 292 to create tension in helper belt 320, the patient experiences helper force originating at constant force spring 310 and having a vertical component no greater than the force rating.

In one example assuming the patient weighs two-hundred pounds, the spring rating is forty pounds, and the force acts vertically upwardly at the patient weight bearing location, a scale positioned under the patient would read one-hundred-sixty pounds rather than two-hundred pounds. At least a component of the helper force applied at weight bearing location 250 is opposite the direction of gravitational attraction on the patient. If, as in this example, it is desired to lift the patient or otherwise counter the effects of gravity, it is advantageous for the force component to be more vertical than horizontal. The presence of the helper force helps lift the patient from his supine position to a standing position. After the patient achieves a standing position, he can move away from bed 40. As he does so, the constant force spring 310 will uncoil from its spindle 312 to accommodate the movement, while still exerting a constant force, until the constant force spring 310 is completely uncoiled. Alternatively, increased vertical separation between the support surface 58 and patient weight bearing location 250 can be accomplished by raising the suspension location 330 from its initial elevation to a higher elevation or by lowering the support surface 58 from its initial elevation 510 to a lower elevation.

During the above described maneuver, the patient will typically help himself and/or will receive assistance from his caregiver, rather than relying exclusively on the assist device. However if the patient loses his balance or begins to fall, the constant force exerted by the constant force spring 310 will partially counteract the gravitational acceleration acting on the patient, thereby making it easier for him to recover from the fall or at least reducing the impact if he is unable to recover in time to avoid contact with bed 40 or floor 68.

Figure 28:
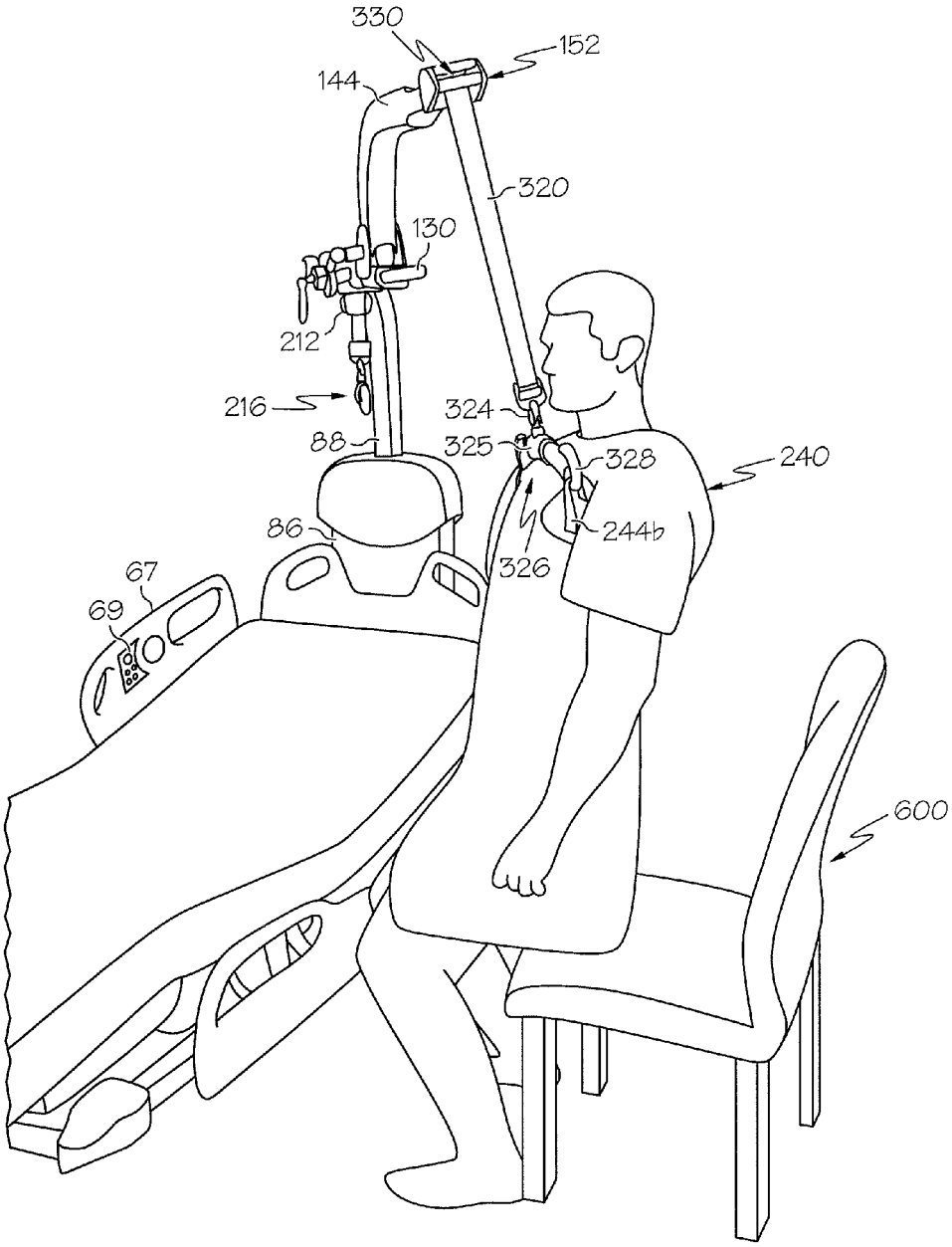
FIG. 28 is a perspective view of the caregiver assist device of FIGS. 24-27 showing the patient moving toward a chair the constant force spring assembly continuing to pulling up on the garment supporting the patient during the transition to the chair.
Figure 29:
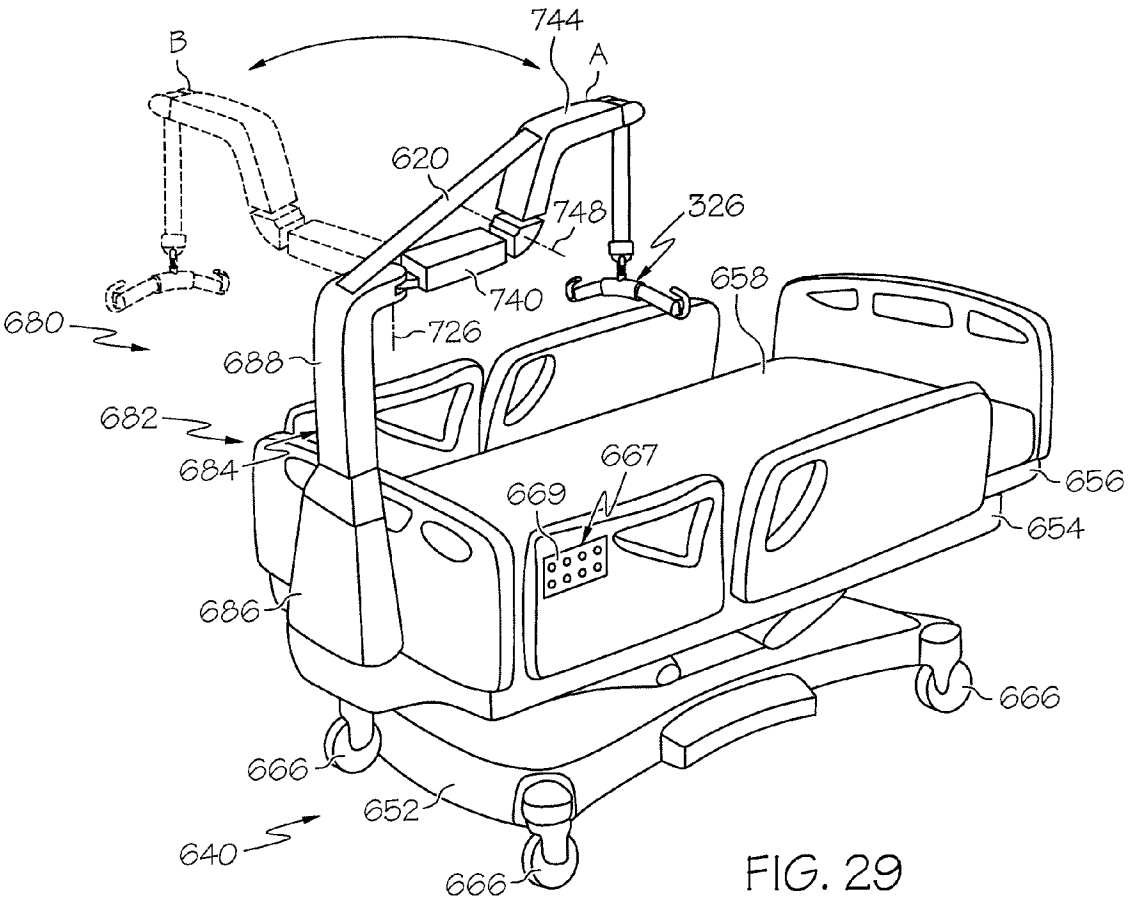
FIG. 29 is a perspective view of another caregiver assist device showing the device with a helper belt coupled to an upper frame of a patient support apparatus.

Although the foregoing example illustrates use of caregiver assist device 80 for moving a bed patient from a supine position on the bed (FIG. 24) to a standing position (FIG. 25), it is evident that helper belt 320 can be used to assist with oppositely directed maneuvers (e.g. standing to sitting or sitting to lying) can also be accomplished by operating the motor to unwrap the belt from its spool, thereby helping to gently lower the patient while still benefitting from the constant force applied by constant force spring assembly 270. FIGS. 28 and 29 show how patient, after having been assisted to a standing position, can remain tethered to helper belt 320 while he moves away from bed 40 or moves to a sitting position in a nearby chair 600. In the event the patient begins to fall, the helper force provided by constant force spring 310 will make it easier for him to recover from the fall or at least reduce the impact if he is unable to recover in time to avoid contact with the floor 68 or other objects.

Helper belt 320 can also be used to help a patient change position on bed 40 without going beyond the footprint of the bed, for example to move from a supine position on bed 40, to a sitting position on bed 40. When used in this way the lateral offset of helper belt suspension location 330 would typically also be within bed 40 footprint, either offset from or aligned with longitudinal centerline 62.

Patient Pull-Up in Bed

Figure 20:
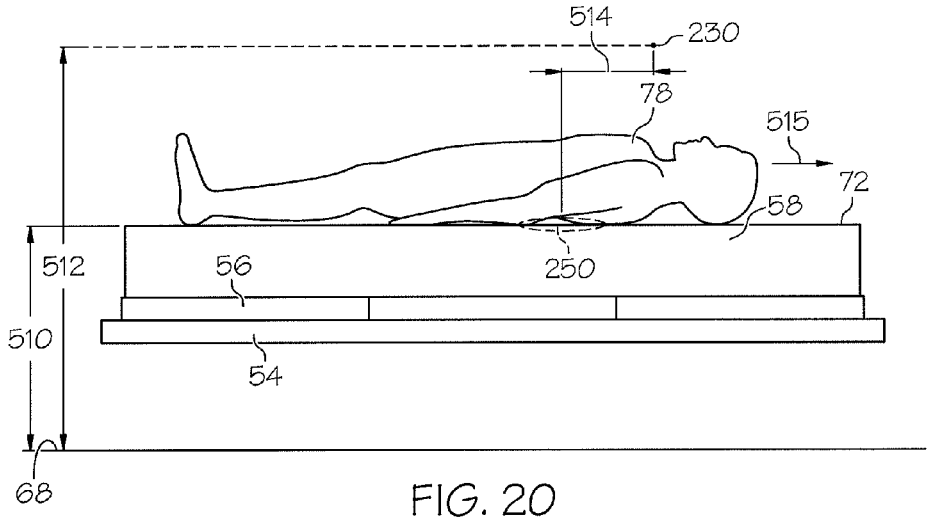
FIG. 20 is a diagrammatic side elevation view of a patient supported on a support surface prior the caregiver assist device being used to pull the patient up in bed showing elevation of the support surface, elevation of an occupant weight bearing location, and a suspension location spaced longitudinally from the occupant weight bearing location.

Turning to FIGS. 20 and 22, one way the above described assist belt 210 can be used is as a "pull up in bed" device for assisting a patient who has migrated toward the foot of bed 40 and needs assistance to be repositioned more toward the head end 42 of bed 40. The patient puts on gown 240 if he or she is not already wearing it. A caregiver moves the carriage 200, and therefore the suspension location 230, to a location longitudinally offset from the weight bearing location 250 associated with the occupant. The longitudinal offset 514 is in a direction of intended translation of the occupant—in this example a direction more toward the head end of the bed. The caregiver orients the boom so that suspension location 230 is not appreciably or intentionally laterally offset from the weight bearing location 250. The caregiver unwinds enough of assist belt 210 from reel 212 to attach clip 224 to hook 204 and to attach garment loops 244*a*, 244*b* to the hooks 220 at the end of the assist holder 216. The caregiver then takes up any residual slack in assist belt 210, or at least as much of the slack as is possible to take up, resulting in the patient being secured to the suspension location 230. In the illustrated embodiment this is accomplished by causing any "excess" assist belt 210 to wind up on reel 212. The above steps need not be carried out in the order given above, however as a practical matter the step of taking up slack in the belt will be done last because the presence of slack facilitates the other steps. With the above steps having been accomplished, the mattress 58 has an initial elevation 510; the suspension location 230 has an initial elevation 512 vertically higher than the support surface initial elevation 510 and also higher than that of the patient; the weight bearing location 250 of the patient is located at support surface initial elevation 510, as suggested in FIG. 20.

An assist force, suggested by arrow 515 in FIGS. 20 and 22, is then applied to the patient at the patient weight bearing location 250. The assist force is sufficient in both magnitude and direction to effect the desired change in the patient's position (i.e. toward the head end of the bed) or to at least assist in effecting the desired change. The assist force is applied by increasing vertical separation between the support surface and the patient weight bearing location. For example, the elevation of the support surface can be lowered from its initial elevation 510 to a lower elevation (e.g. by lowering upper frame 54). As the support surface 58 moves away from weight bearing location 250, tension in assist belt 210 exerts assist force that extends from weight bearing location 250 toward the suspension location 230. As a result, the patient will be pulled headwardly, as suggested by arrow 515, until the assist belt segment between suspension location 230 and the garment loops 244*a*, 244*b* is vertical. Support surface 58 is then raised to relieve the tension in assist belt 210 and transfer the patient's weight back onto the support surface 58.

In other embodiments, increasing the vertical separation may be achieved by raising the elevation of weight bearing location 250 from its initial elevation 510 to a higher elevation. This may be accomplished by using an electric motor in lieu of reel 212. The elevation of weight bearing location 250 might also be accomplished by raising the elevation of suspension location 230, e.g. by configuring frame 82 so that boom 120 is rotatable about a horizontal axis traverse to axis 126 and providing a means to rotate the boom upwardly against the patient's weight.

Irrespective of how the increased vertical separation is achieved, it may be desirable to decrease the vertical separation between weight bearing location 250 and suspension location 230 prior to taking up residual slack in assist belt 210. For example, in the case where the vertical separation is to be accomplished by lowering support surface 58 from its initial elevation 510 to a lower elevation, it may be desirable to raise support surface 58 to a relatively high elevation before taking up any residual slack.

The foregoing example contemplates that suspension location 230 is not appreciably or intentionally laterally offset from weight bearing location 250. As a result, the patient's direction of motion will be substantially exclusively in the longitudinal direction as suggested by arrow 515 in FIGS. 20 and 22. However lateral offset can be employed if it is desired to also introduce a lateral directional component to the patient's direction of motion.

Patient Turn Assist

Figure 21:
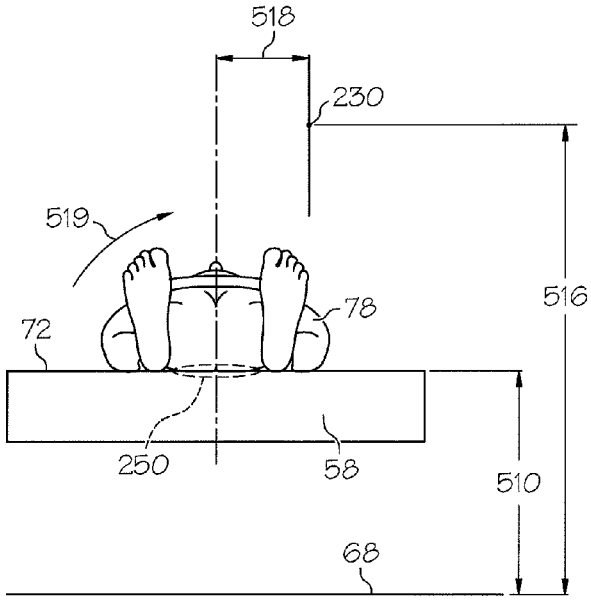
FIG. 21 is diagrammatic end elevation view of a patient of supported on a support surface prior to the caregiver assist device being used to assist in patient turning showing elevation of the support surface, elevation of an occupant weight bearing location, and a suspension location spaced laterally from the occupant weight bearing location.

Assist belt 210 can be used for turn assist as suggested in FIGS. 21 and 23. Turn assist refers to turning or rolling a patient from a supine orientation to one in which he is lying at least partially on his left or right side. Other similar turning or rolling maneuvers are also subsumed under the category of turn assist. To affect turn assist, the patient puts on gown 240 if he's not already wearing it. The caregiver rotates boom 120 about axis 126 to move suspension location 230, to a location laterally offset from weight bearing location 250 associated with the patient and positions carriage 200 so that suspension location 230 is not appreciably or intentionally longitudinally offset from weight bearing location 250. Lateral offset 518, shown, for example, in FIG. 21, is in a direction of intended movement of the patient—in this example a direction more toward the left side of the bed. The caregiver unreels enough of assist belt 210 from reel 212 to attach clip 224 to hook 204 of carriage 200 and to attach one of the holder hooks 220 to whichever of the garment loops 244*a*, 244*b* is further away from the direction of intended patient rotation. For example, hook 244*b* is illustratively attached to loop 244*b* of garment 240 worn by a patient as shown in FIG. 23. As a consequence the resultant weight bearing location 250 is laterally offset from the patient's saggital anatomic plane as suggested in FIG. 21. The caregiver then takes up any residual slack in assist belt 210, or at least as much of the slack as is possible to take up, thereby securing the patient to suspension location 230. In the illustrated embodiment this is accomplished by causing any "excess" belt to wind up on reel 212. The above steps need not be carried out in the order given above, however as a practical matter the step of taking up slack in assist belt 210 will be done last because the presence of slack facilitates the other steps.

With the above steps having been accomplished, the mattress 58 has initial elevation 510; suspension location has an initial elevation 516 vertically higher than the support surface initial elevation 510 and also higher than that of the patient; weight bearing location 250 is essentially the same as support surface initial elevation 510. An assist force is then applied to the patient at patient weight bearing location 250. The assist force is sufficient in both magnitude and direction to effect the desired change in the patient's position (i.e. to effect a roll to one side) or to at least assist in effecting the desired change. The assist force is applied by increasing vertical separation between the support surface 58 and patient weight bearing location 250. For example, the elevation of support surface 58 can be lowered from its initial elevation 510 to a lower elevation (e.g. by lowering upper frame 54). As the support surface 58 moves away from weight bearing location 250, tension in assist belt 210 exerts the assist force extending from weight bearing location 250 toward suspension location 230. As a result, the patient will be turned as seen in FIG. 23 until the assist belt segment between suspension location 230 and the garment loop 244*b* is approximately vertical. If the patient is able to remain on his side without assistance, the support surface 58 may then be raised to relieve the tension in assist belt 210 and transfer the patient's weight back onto the support surface 58.

As with the "pull up in bed" maneuver, increasing the vertical separation might be achieved alternatively by raising the elevation of at least part of weight bearing region 250 from its initial elevation 510 to a higher elevation. This might be accomplished by using an electric motor in lieu of reel 212. The elevation might also be accomplished by raising the elevation of the suspension location, e.g. by configuring frame 82 so that boom 120 is rotatable about a horizontal axis traverse to axis 126 and providing a means to rotate boom 120 upwardly against the patient's weight.

The foregoing example contemplates that suspension location 230 is not appreciably or intentionally longitudinally offset from the weight bearing location. As a result, the direction of the patient's turn will be 20 substantially exclusively toward the right or left side of bed 40. However longitudinal offset can be employed if it is desired to also introduce a longitudinal directional component to the patient's motion.

Other Caregiver Assistance Devices

Another caregiver assist device 680 is shown coupled to a patient support apparatus, illustratively a bed 640, in FIG. 29. Device 680 is similar to device 80 described above and provides patient mobility support as described above via a helper belt 620. However, device 680 does not include an assist belt 210 or carriage 200 as described above. Additionally unlike device 80 described above, device 680 is coupled to an upper frame 654 of bed 640. Helper holder 326 described above is coupled to helper belt 620 for coupling helper belt 620 to a patient.

Bed 40 includes a base frame 652, an upper frame 654, and a deck 656 as shown in FIG. 29. Base frame 652 includes a plurality of casters 666 supporting bed 640 for movement. Upper frame 654 is supported above base frame 652 by a pair of lift arms (not shown) extending between base frame 652 and upper frame 654. The lift arms are pivotable to raise and lower upper frame 654 relative to base frame 652. A support surface, illustratively a mattress 658 is supported on deck 656 and is raised and lowered with deck 656. Additionally, bed 640 includes a barrier, illustratively a head rail 667 with a user input 669 operable by a caregiver for raising and lowering upper frame 654 relative to base frame 652. Since device 80 is coupled to upper frame 654, device 80 moves up and down relative to base frame 652 with upper frame 654.

Device 80 includes a frame 682 with a support structure 684 and a boom 720 that is operationally similar to boom 120 described above. Support structure 684 has a base portion 686 and an upper portion 688. Base portion 686 is coupled to upper frame 654 and houses a constant force spring assembly (not shown) that is substantially similar to constant force spring assembly 270 described above. Upper portion 688 extends up from base portion 686 and guides a helper belt 620 up to boom 720.

Boom 720 extends substantially horizontally from support structure 684 and includes a base arm 740 and an extension 744 as shown in FIG. 29. Base arm 740 is pivotably coupled to upper portion 688 of support structure 684 for movement about axis 726. Extension 744 is substantially similar to extension 144 described above and is pivotably coupled to base arm 740 for movement about an axis 748. Boom 720 moves between an overbed position, as suggested by letter A in FIG. 29, and an out-of-bed position, as suggested by letter B in FIG. 29. When boom 720 is in the overbed position, helper belt 620 is operable to support a patient moving around on bed 640. When boom 720 is in the out-of-bed position, helper belt 620 is operable to support a patient moving around off of bed 640, such as standing near bed 640, getting into or out of another patient support (not shown), or getting into bed 640.

Although certain illustrative embodiments have been described in detail above, variations and modifications exist within the scope and spirit of this disclosure as described and as defined in the following claims.

The invention claimed is:

1. A caregiver assist apparatus for transferring a person off of a support apparatus, the caregiver assist apparatus comprising a support structure extending substantially vertically, a boom mounted to the support structure extending outwardly from a substantially vertical axis extending along the support structure, the boom capable of supporting a person above the support apparatus when the boom is positioned over the support apparatus, the boom including a base arm and an extension situated above the base arm, and a holder positioner slidably coupled to the boom, the base arm pivotably coupled to the support structure for movement about the substantially vertical axis and the extension pivotably coupled to the base arm for movement about a substantially horizontal axis.

2. The caregiver assist apparatus of claim 1, wherein the boom is rotatable from a first position over the support apparatus to a second position past a side of the support apparatus.

3. The caregiver assist apparatus of claim 1, wherein the boom rotates independent of the support structure.

4. The caregiver assist apparatus of claim 1, wherein the boom is movable between a use position and a stowed position when the extension rotates about the substantially horizontal axis.

5. The caregiver assist apparatus of claim 1, further comprising a force transmission device adapted to engage a weight-bearing apparatus, the force transmission device capable of supporting a person positioned on the weight-bearing apparatus above the support apparatus by transferring the patient's weight to the boom.

6. The caregiver assist apparatus of claim 5, wherein the force transmission device is coupled to the support structure and extends along the boom.

7. The caregiver assist apparatus of claim 6, wherein the force transmission device is slidable relative to the boom.

8. The caregiver assist apparatus of claim 7, wherein the force transmission device includes a belt coupled to a belt tensioner.

9. The caregiver assist apparatus of claim 8, wherein the belt tensioner includes a carrier slidably coupled to the support structure and a constant force spring coupled between the carrier and a base of the support structure.

10. The caregiver assist apparatus of claim 9, wherein the carrier is slidable vertically along the support structure and includes a frame, a motor coupled to the frame, and a drum coupled to the frame and engaged with the motor, the belt being coupled to the drum and the motor operating to rotate the drum to adjust the length of the belt.

11. The caregiver assist apparatus of claim 7, wherein the weight-bearing assembly includes a strap having a first end, a second end, a first loop coupled to the first end, and a second loop coupled to the second end.

12. The caregiver assist apparatus of claim 1, wherein a vertical distance between the boom and the support apparatus is variable.

13. The caregiver assist apparatus of claim 1, wherein the support structure is coupled to the support apparatus.

14. The caregiver assist apparatus of claim 13, wherein the support structure is coupled to the support apparatus at a head end.

15. The caregiver assist apparatus of claim 1, further including a patient holder extending downwardly from the holder positioner.

* * * * *